US010073375B2

(12) United States Patent
Mimura et al.

(10) Patent No.: US 10,073,375 B2
(45) Date of Patent: Sep. 11, 2018

(54) TONER CASE AND IMAGE FORMING APPARATUS

(71) Applicant: KYOCERA Document Solutions Inc., Osaka (JP)

(72) Inventors: Daisuke Mimura, Osaka (JP); Nobuhiro Fukuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/836,199

(22) Filed: Dec. 8, 2017

(65) Prior Publication Data

US 2018/0164713 A1 Jun. 14, 2018

(30) Foreign Application Priority Data

Dec. 9, 2016 (JP) ..... 2016-239512
Dec. 22, 2016 (JP) ..... 2016-249283
(Continued)

(51) Int. Cl.
*G03G 15/08* (2006.01)
*G03G 21/16* (2006.01)

(52) U.S. Cl.
CPC ..... *G03G 15/0837* (2013.01); *G03G 15/0865* (2013.01); *G03G 15/0875* (2013.01);
(Continued)

(58) Field of Classification Search
USPC ..... 399/107, 110, 111, 119, 120, 252, 258, 399/262, 263
See application file for complete search history.

(56) References Cited

U.S. PATENT DOCUMENTS 7,463,834 B2 * 12/2008 Takagi ..... G03G 15/0896 399/12
8,600,246 B2 * 12/2013 Kurimoto ..... G03G 21/12 399/120
(Continued)

FOREIGN PATENT DOCUMENTS

EP 2530532 A1 12/2012
EP 3081991 A1 10/2016
JP 2001-305841 A 11/2001

OTHER PUBLICATIONS

Extended European Search Report issued by the European Patent Office dated May 18, 2018, which corresponds to EP17206078.2-1022 and is related to U.S. Appl. No. 15/836,199.
(Continued)

*Primary Examiner* — Hoan Tran
(74) *Attorney, Agent, or Firm* — Studebaker & Brackett PC

(57) ABSTRACT

A toner case includes a case main body, a rotator, a transmitter and a moving mechanism. The case main body stores a toner. The rotator is stored in the case main body and rotates around a rotation axis. The transmitter is arranged outside the case main body and transmits rotation to the rotator. The moving mechanism moves the transmitter between a first position and a second position which is arranged at an outside of the first position in a rotation axis direction of the rotator. The moving mechanism includes a holder holding the transmitter. As the holder moves with respect to the case main body, the transmitter moves between the first position and the second position.

17 Claims, 26 Drawing Sheets

(30) Foreign Application Priority Data

Dec. 22, 2016 (JP) ..... 2016-249284
Jul. 10, 2017 (JP) ..... 2017-134885

(52) U.S. Cl.
CPC ..... *G03G 21/1647* (2013.01); *G03G 15/0886* (2013.01); *G03G 15/0889* (2013.01); *G03G 15/0891* (2013.01); *G03G 2215/0665* (2013.01)

(56) References Cited

U.S. PATENT DOCUMENTS 8,666,293 B2 * 3/2014 Mushika ..... G03G 15/0863 399/120
8,958,728 B2 * 2/2015 Hotani ..... G03G 15/0832 399/263
9,436,126 B1 9/2016 Anderson, Jr. et al.
2005/0196184 A1 9/2005 Koyama et al.
2012/0263504 A1 10/2012 Nagashima
2012/0328307 A1 12/2012 Oda et al.
2014/0044459 A1 2/2014 Hotani
2015/0139688 A1 5/2015 Leemhuis et al.
2016/0154376 A1 6/2016 Xiao et al.

OTHER PUBLICATIONS

Extended European Search Report issued by the European Patent Office dated Mar. 27, 2018, which corresponds to EP17206088.1-1022 and is related to U.S. Appl. No. 15/836,199.
Extended European Search Report issued by the European Patent Office dated Apr. 20, 2018, which corresponds to EP17206076.6-1022 and is related to U.S. Appl. No. 15/836,199.

* cited by examiner

TONER CASE AND IMAGE FORMING APPARATUS

INCORPORATION BY REFERENCE

This application is based on and claims the benefit of priorities from Japanese patent application No. 2016-239512 filed on Dec. 9, 2016, Japanese patent application No. 2016-249283 filed on Dec. 22, 2016, Japanese patent application No. 2016-249284 filed on Dec. 22, 2016 and Japanese patent application No. 2017-134885 filed on Jul. 10, 2017, which are incorporated by reference in their entirety.

BACKGROUND

The present disclosure relates to a toner case and an image forming apparatus including the toner case.

An image forming apparatus, such as a printer, a copying machine, a facsimile and a multifunctional peripheral, includes a toner case which replenishes a developing device with a toner (a developer). For instance, the toner case includes a case main body storing the toner, a rotator stored in the case main body and rotating around a rotation axis and a transmitter arranged outside the case main body and transmitting rotation to the rotator. In such a toner case, by transmitting the rotation from the transmitter to the rotator, the toner in the case main body is agitated or conveyed by the rotator.

SUMMARY

In accordance with an aspect of the present disclosure, a toner case includes a case main body, a rotator, a transmitter and a moving mechanism. The case main body stores a toner. The rotator is stored in the case main body and rotates around a rotation axis. The transmitter is arranged outside the case main body and transmits rotation to the rotator. The moving mechanism moves the transmitter between a first position and a second position which is arranged at an outside of the first position in a rotation axis direction of the rotator. The moving mechanism includes a holder holding the transmitter. As the holder moves with respect to the case main body, the transmitter moves between the first position and the second position.

In accordance with an aspect of the present disclosure, an image forming apparatus includes the toner case and an attachment part to which the toner case is detachably attached.

In accordance with an aspect of the present disclosure, a toner case is detachably attached to an attachment part of an image forming apparatus. The toner case includes a case main body, a rotator, a transmitter and a moving mechanism. The case main body stores a toner. The rotator is stored in the case main body and rotates around a rotation axis. The transmitter is arranged outside the case main body and transmits rotation to the rotator. The moving mechanism moves the transmitter between a first position and a second position which is arranged at an outside of the first position in a rotation axis direction of the rotator. The moving mechanism includes a holder holding the transmitter. The attachment part includes a restriction part which comes into contact with the holder to restrict rotation of the holder. As the case main body rotates with respect to the holder in a state where the restriction part comes into contact with the holder, the transmitter moves from the first position to the second position.

In accordance with an aspect of the present disclosure, an image forming apparatus includes a toner case and an attachment part to which the toner case is detachably attached. The toner case includes a case main body, a rotator, a transmitter, and a moving mechanism. The case main body stores a toner. The rotator is stored in the case main body and rotates around a rotation axis. The transmitter is arranged outside the case main body and transmits rotation to the rotator. The moving mechanism moves the transmitter between a first position and a second position which is arranged at an outside of the first position in a rotation axis direction of the rotator. The moving mechanism includes a holder holding the transmitter. The attachment part includes a restriction part which comes into contact with the holder to restrict rotation of the holder. As the case main body rotates with respect to the holder in a state where the restriction part comes into contact with the holder, the transmitter moves from the first position to the second position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A First Embodiment

Hereinafter, a first embodiment of the present disclosure will be described with reference to FIG. 1 to FIG. 18.

Figure 1:
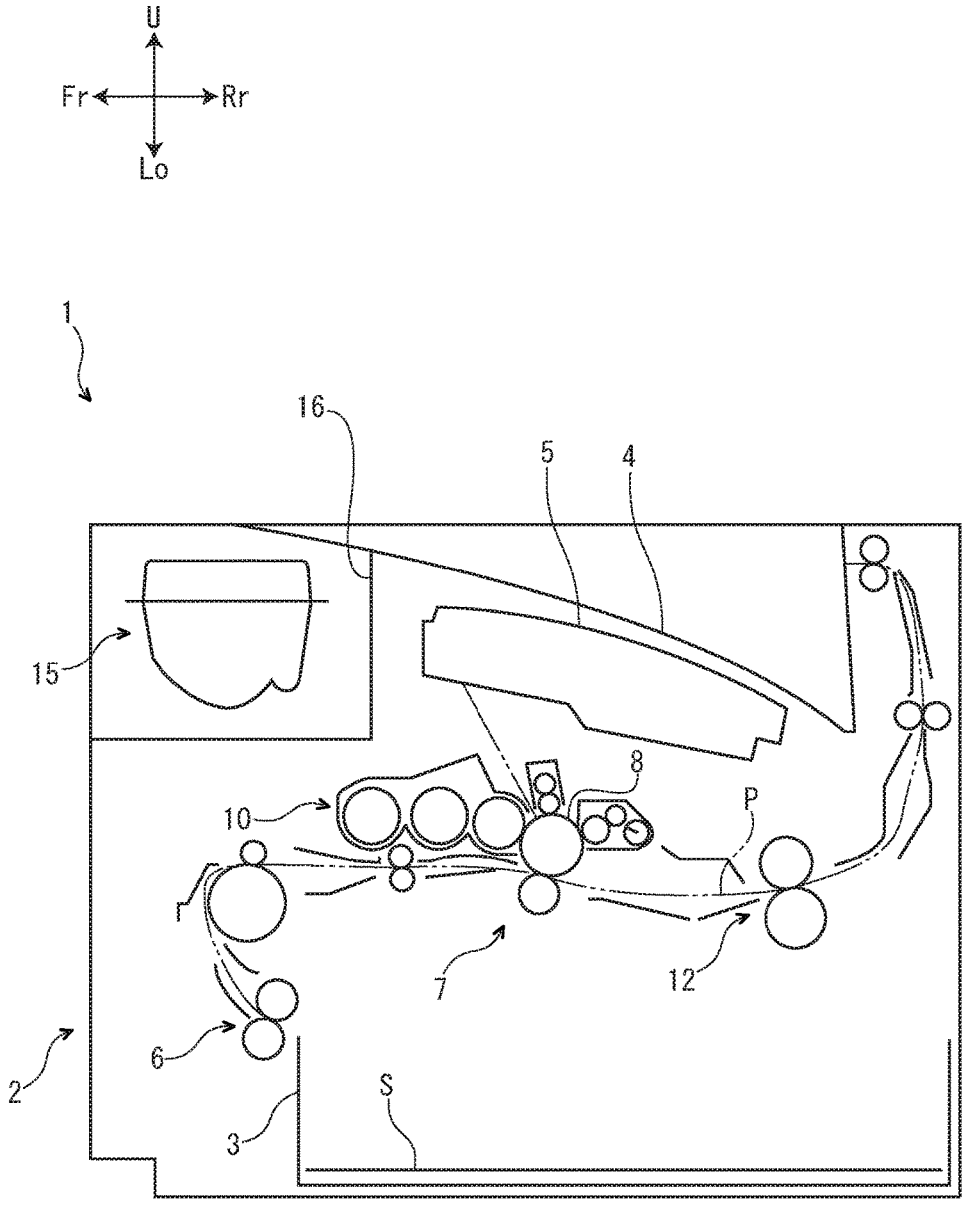
FIG. 1 is a schematic view showing a printer according to a first embodiment of the present disclosure.

Firstly, an entire structure of a printer 1 (an example of an image forming apparatus) will be described. In the following description, for convenience of explanation, a left side on FIG. 1 is defined to be a front side of the printer 1. Arrows Fr, Rr, L, R, U and Lo shown in each figure respectively indicate a front side, a rear side, a left side, a right side, an upper side and a lower side of the printer 1.

With reference to FIG. 1, the printer 1 includes a box-shaped printer main body 2 (an example of an apparatus main body). In a lower portion of the printer main body 2, a sheet feeding cassette 3 storing a sheet S (an example of a recording medium) is stored. On an upper face of the printer main body 2, an ejected sheet tray 4 is provided. In an upper portion of the printer main body 2, an exposing device 5 is stored below the ejected sheet tray 4.

Inside the printer main body 2, a conveying path P for the sheet S is provided. At an upstream end of the conveying path P, a sheet feeding part 6 is provided. At a middle portion of the conveying path P, an image forming part 7 is provided. The image forming part 7 includes a photosensitive drum 8 and a developing device 10. Ata downstream portion of the conveying path P, a fixing device 12 is provided.

In a front upper portion of the printer main body 2, a toner container 15 (an example of a toner case) is stored. The toner container 15 is detachably attached to an attachment part 16.

Next, an operation of the printer 1 having the above described configuration will be described.

Firstly, laser light (refer to a two-dotted line in FIG. 1) emitted from the exposing device 5 exposes the photosensitive drum 8 to form an electrostatic latent image on the photosensitive drum 8. Next, the electrostatic latent image on the photosensitive drum 8 is developed by the developing device 10 to a toner image. Thereby, an image forming operation is finished.

On the other hand, the sheet S fed from the sheet feeding cassette 3 by the sheet feeding part 6 is conveyed to the image forming part 7 synchronously with the above described image forming operation. At the image forming part 7, the above toner image is transferred on the sheet S from the photosensitive drum 8. The sheet S on which the toner image is transferred is conveyed to the downstream side along the conveying path P and enters the fixing device 12. The fixing device 12 fixes the toner image on the sheet S. The sheet S on which the toner image is fixed is ejected on the ejected sheet tray 4 from a downstream end of the conveying path P.

Next, the toner container 15 will be described in detail.

Figure 2:
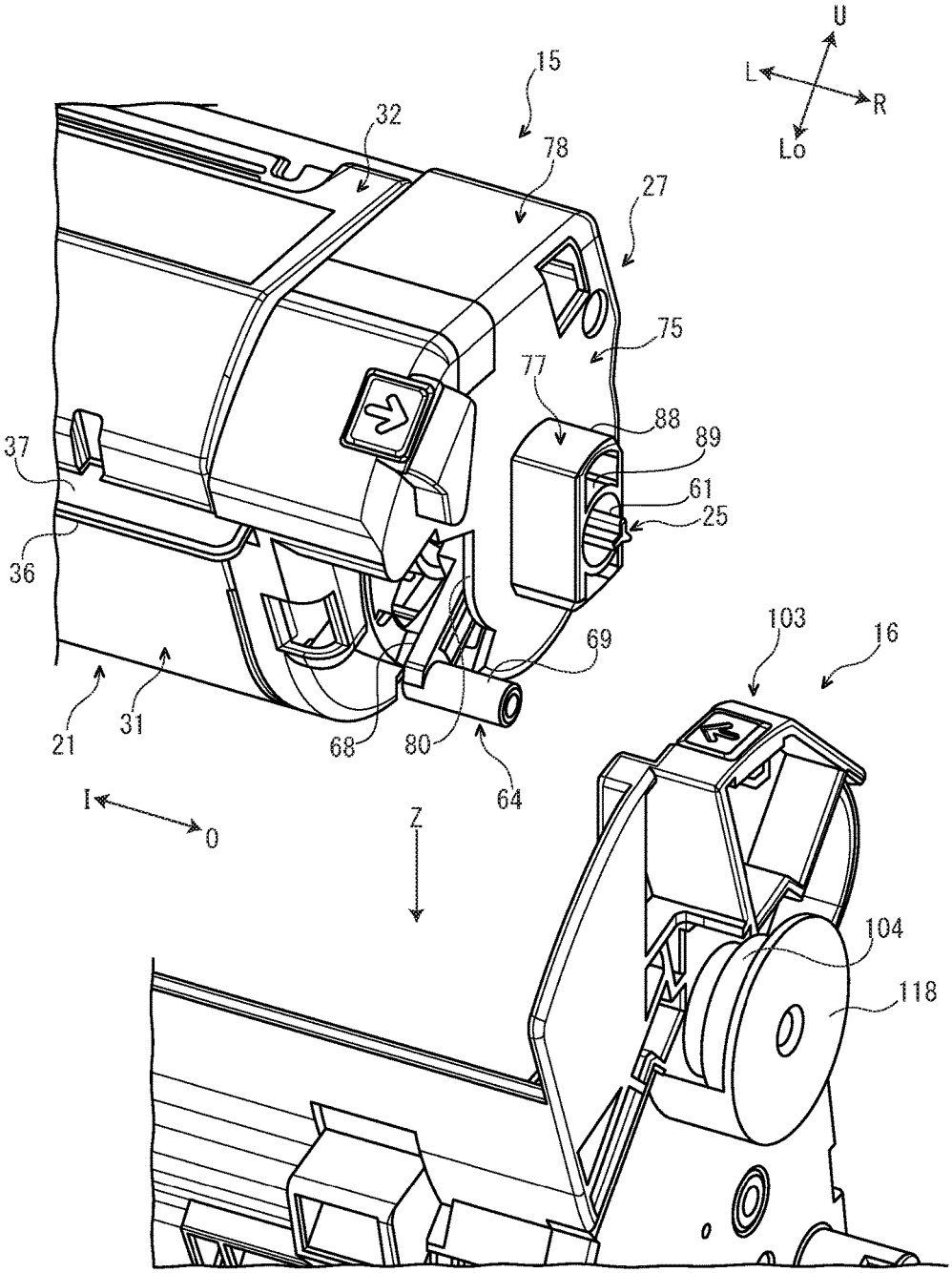
FIG. 2 is a perspective view showing a right side portion of a toner container and a right side portion of an attachment part according to the first embodiment of the present disclosure.

An arrow O shown in each figure after FIG. 2 indicates an outside in the left-and-right direction of the toner container 15, and an arrow I shown in each figure after FIG. 2 indicates an inside in the left-and-right direction of the toner container 15.

Figure 3:
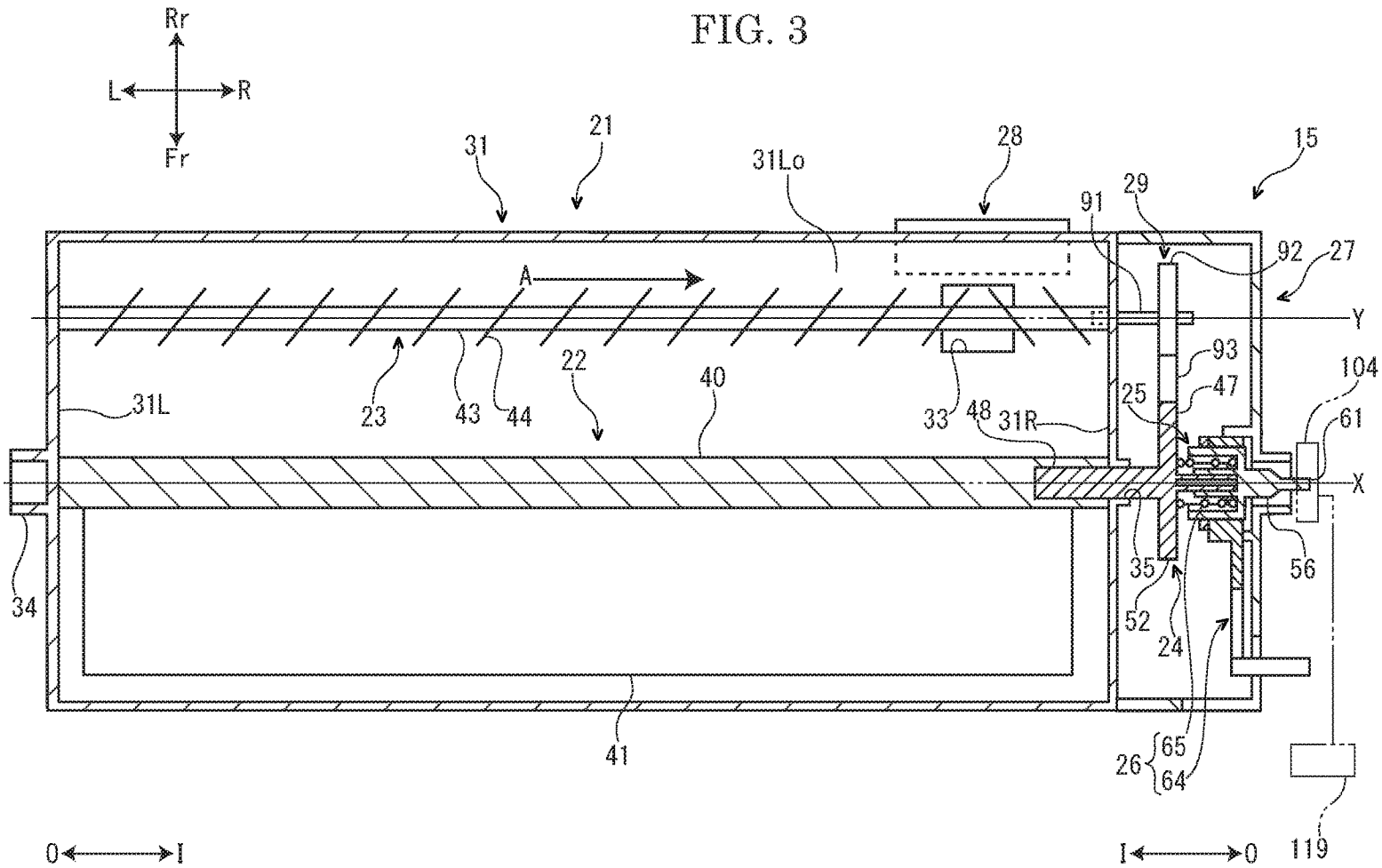
FIG. 3 is a sectional view schematically showing the toner container according to the first embodiment of the present disclosure.

With reference to FIG. 2 and FIG. 3, the toner container 15 includes a case main body 21, an agitator 22 (an example of a rotator) stored in a center portion of the case main body 21, a conveyer 23 (an example of a rotator) stored in a rear lower portion of the case main body 21, a supporter 24 arranged at a right end side of the case main body 21, a transmitter 25 and a moving mechanism 26 which are arranged at a right side (the outside in the left-and-right direction) of the supporter 24, a cover 27 covering a right side (the outside in the left-and-right direction) of the case main body 21, a shutter 28 arranged at a rear lower side of a right side portion of the case main body 21 and a connector 29 arranged at a rear lower side of the supporter 24.

Figure 4:
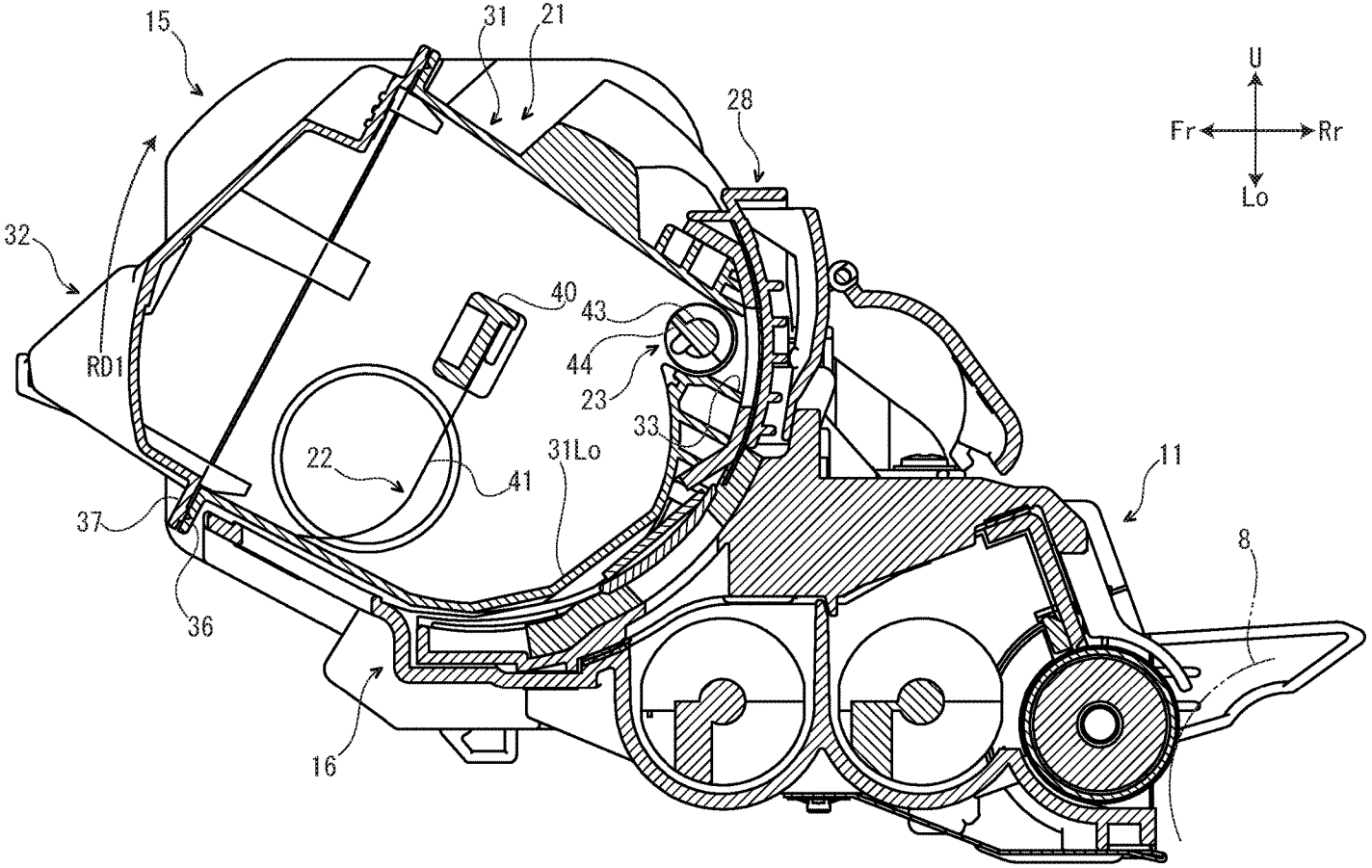
FIG. 4 is a sectional view showing a state where a case main body of the toner container is in a first rotating position, in the printer according to the first embodiment of the present disclosure.
Figure 5:
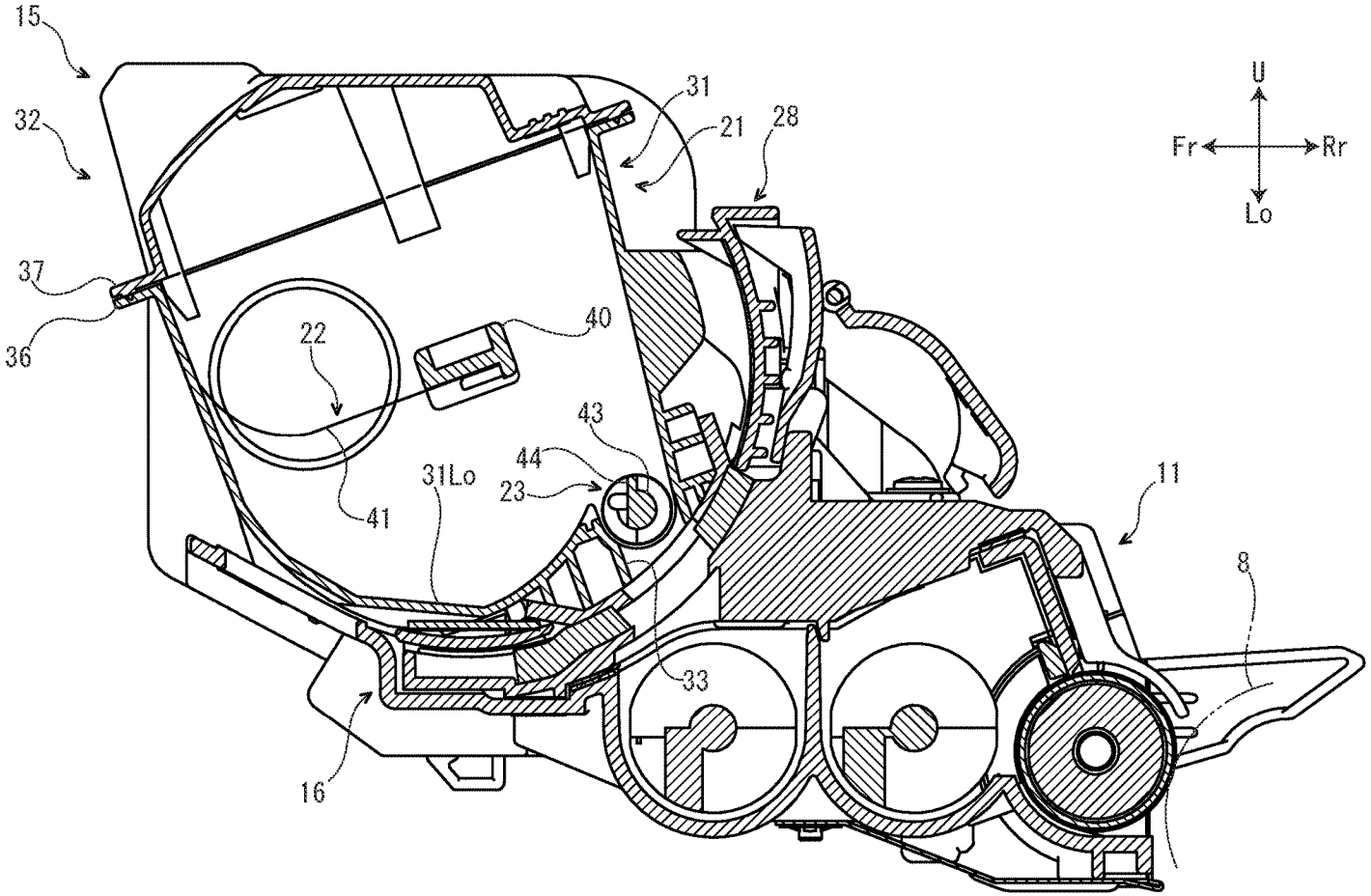
FIG. 5 is a sectional view showing a state where the case main body of the toner container is in a second rotating position, in the printer according to the first embodiment of the present disclosure.

With reference to FIG. 4 and FIG. 5, the case main body 21 of the toner container 15 is rotatable between a first rotating position (refer to FIG. 4) and a second rotating position (refer to FIG. 5), in a state where the toner container 15 is attached to the attachment part 16 (described later in detail). In the following description regarding the case main body 21, words showing directions, such as upper, lower, left, right, front and rear, are used on the basis of a state where the case main body 21 is in the second rotating position. An arrow RD1 suitably shown in each figure indicates a rotating direction of the case main body 21 from the first rotating position to the second rotating position (hereinafter, called as "a rotating direction RD1").

With reference to FIG. 2 and FIG. 3, the case main body 21 has a shape elongated in the left-and-right direction. The case main body 21 stores a toner (a developer). The case main body 21 includes a storage 31 and a lid 32 provided at an upper side of the storage 31.

The storage 31 of the case main body 21 is formed in a box-like shape whose upper side is opened. In a right rear portion of a bottom wall 31Lo of the storage 31, a discharge port 33 through which the toner is discharged is provided. On a center portion of a left side wall 31L of the storage 31, an engaging part 34 protruding to the left side (the outside in the left-and-right direction) is provided. In a center portion of a right side wall 31R of the storage 31, a supporting hole 35 is provided. Around an upper end of an outer circumference of the storage 31, a lower side flange portion 36 is provided.

The lid 32 of the case main body 21 is formed in a box-like shape whose lower side is opened. Around a lower end of an outer circumference of the lid 32, an upper side flange portion 37 is provided. The upper side flange portion 37 is fixed to the lower side flange portion 36 of the storage 31. Thereby, the lid 32 is integrated with the storage 31. An inner space of the lid 32 is communicated with an inner space of the storage 31.

With reference to FIG. 3, the agitator 22 of the toner container 15 is stored in the storage 31 of the case main body 21. The agitator 22 is rotatable around a first rotation axis X extending along the left-and-right direction. That is, the left-and-right direction is a rotation axis direction of the agitator 22 in the present embodiment. The agitator 22 includes an agitating shaft 40 extending along the left-and-right direction and an agitating blade 41 mounted to the agitating shaft 40. The agitating blade 41 is made of resin film, for example, and formed in a sheet-like shape.

The conveyer 23 of the toner container 15 is stored in the storage 31 of the case main body 21. The conveyer 23 is rotatable around a second rotation axis Y extending along the left-and-right direction. That is, the left-and-right direction is a rotation axis direction of the conveyer 23 in the present embodiment. The conveyer 23 includes a conveying shaft 43 extending along the left-and-right direction and a spiral conveying fin 44 protruding on an outer circumference of the conveying shaft 43.

Figure 6:
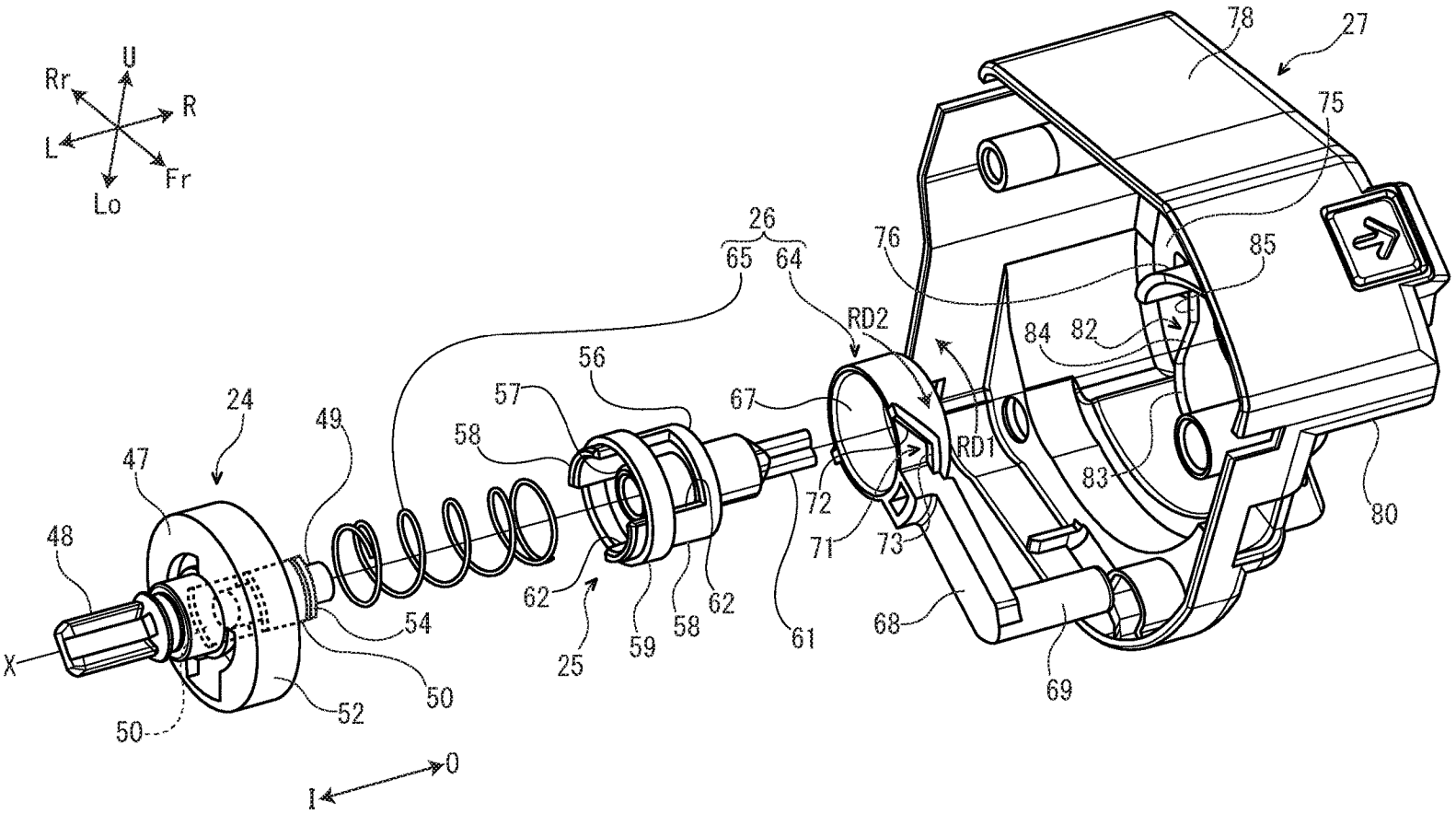
FIG. 6 is a disassembled perspective view showing a supporter, a transmitter, a moving mechanism and a cover, in the toner container according to the first embodiment of the present disclosure.

With reference to FIG. 6, the supporter 24 of the toner container 15 includes an annular exposed piece 47, a coupling piece 48 protruding from a center portion of the exposed piece 47 to the left side (the inside in the left-and-right direction), a boss piece 49 protruding from the center portion of the exposed piece 47 to the right side (the outside in the left-and-right direction) and a pair of inserted pieces 50 protruding from the exposed piece 47 at an outer circumference of the boss piece 49 to the right side (the outside in the left-and-right direction).

With reference to FIG. 3, the exposed piece 47 of the supporter 24 is arranged at the right side (the outside in the left-and-right direction) of the storage 31 of the case main body 21, and exposed to an outside of the case main body 21. Around an outer circumferential face of the exposed piece 47, a driving gear 52 is provided.

The coupling piece 48 of the supporter 24 penetrates through the supporting hole 35 provided in the right side wall 31R of the storage 31 of the case main body 21. Thereby, the supporter 24 is rotatably supported by the case main body 21. A tip end portion of the coupling piece 48 is inserted into an inside of the storage 31, and fixed to a right end portion of the agitating shaft 40 of the agitator 22. Thereby, the supporter 24 is connected to the agitator 22, and rotatable together with the agitator 22 around the first rotation axis X.

With reference to FIG. 6, at a right end portion (an end portion at the outside in the left-and-right direction) of each inserted piece 50 of the supporter 24, a hook 54 is provided. The hook 54 is protruded to an outside in a radial direction (a direction separated from the first rotation axis X).

Figure 7:
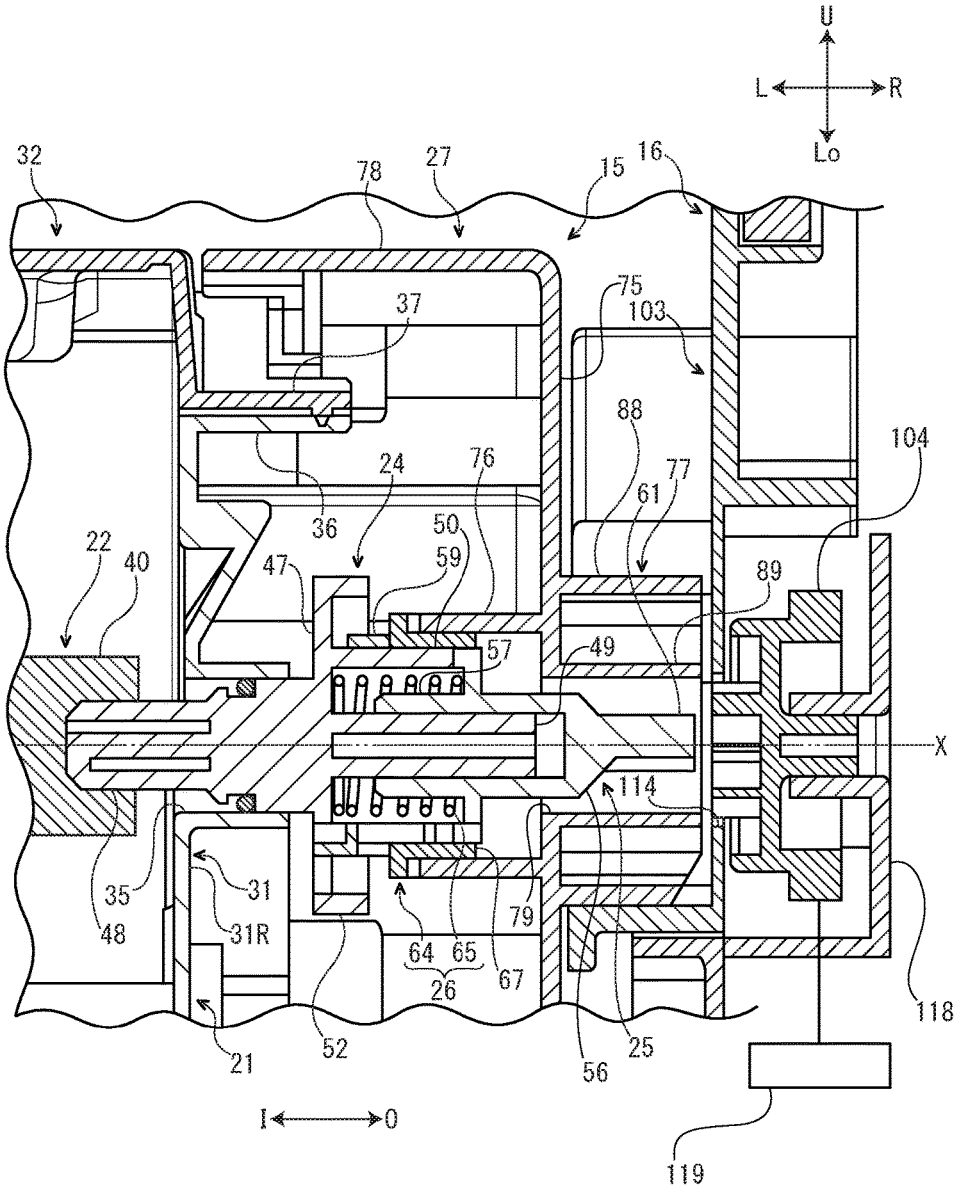
FIG. 7 is a sectional view showing a state where the transmitter is in a first position, in the toner container according to the first embodiment of the present disclosure.
Figure 8:
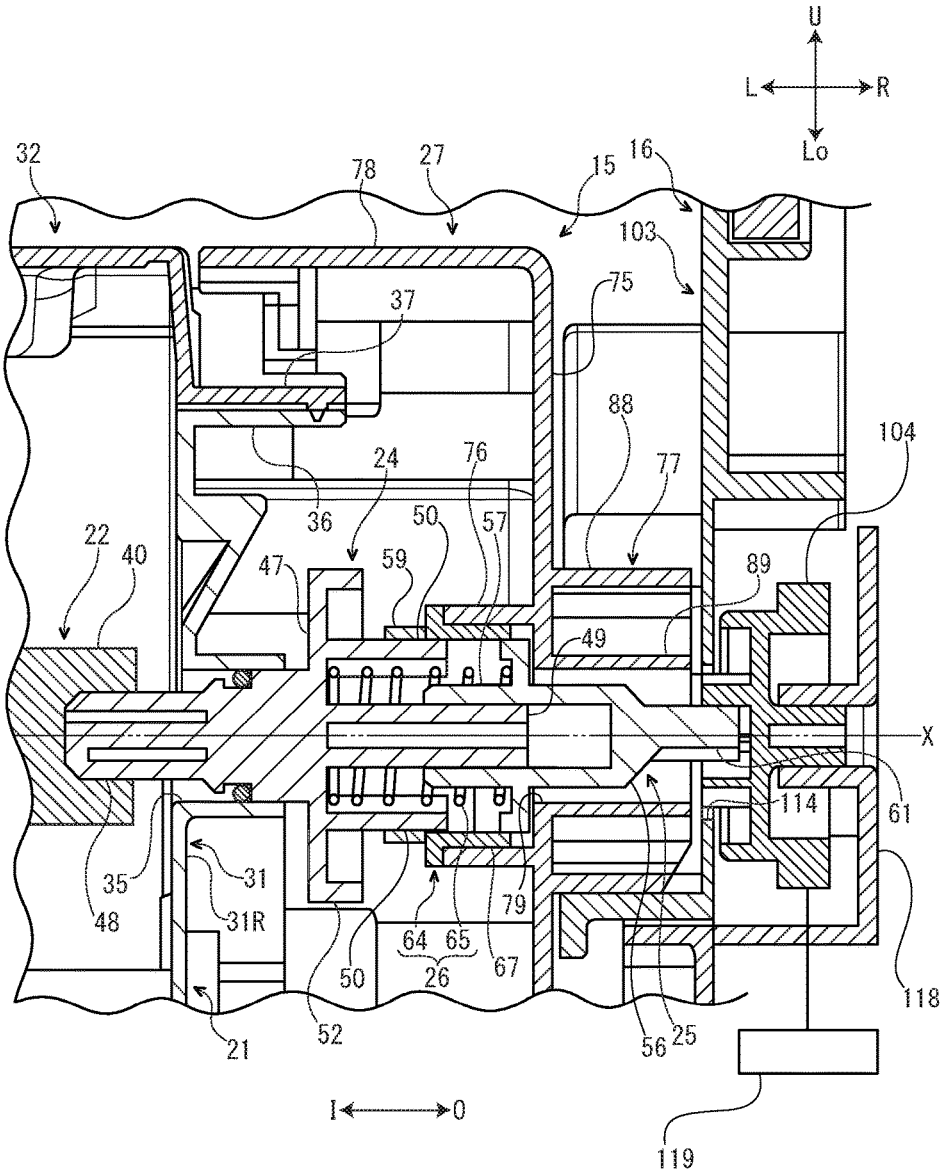
FIG. 8 is a sectional view showing a state where the transmitter is in a second position, in the toner container according to the first embodiment of the present disclosure.

With reference to FIG. 7 and FIG. 8, the transmitter 25 of the toner container 15 is arranged at the right side (the outside in the left-and-right direction) of the storage 31 of the case main body 21 and outside the case main body 21. The transmitter 25 moves linearly along the left-and-right direction between a first position (refer to FIG. 7) and a second position (refer to FIG. 8) which is arranged at the right side (the outside in the left-and-right direction) of the first position.

With reference to FIG. 6, the transmitter 25 includes a transmitting piece 56, a cylindrical piece 57 protruding from a center portion of the transmitting piece 56 to the left side (the inside in the left-and-right direction), a pair of protruding pieces 58 protruding from the transmitting piece 56 at an outer circumference of the cylindrical piece 57 to the left side (the inside in the left-and-right direction) and an approximate annular fixing piece 59 fixed to outer circumferential faces of left side portions of the pair of protruding pieces 58. On a right face (a face at the outside in the left-and-right direction) of the transmitting piece 56, a transmitting coupling 61 is provided. Into the cylindrical piece 57, the boss piece 49 of the supporter 24 is inserted. A pair of inserting grooves 62 is formed between the pair of protruding pieces 58. Into each inserting groove 62, each inserted piece 50 of the supporter 24 is inserted. According to the configuration described above, the transmitter 25 is supported by the supporter 24 in a state where the transmitter 25 is movable along the left-and-right direction and is not rotatable with respect to the supporter 24. The fixing piece 59 engagingly locks the hook 54 of each inserted piece 50. Thereby, each inserted piece 50 is inhibited from being removed from each inserting groove 62.

With reference to FIG. 6, the moving mechanism 26 of the toner container 15 includes a holder 64 and a coil spring 65 (an example of a biasing member).

With reference to FIG. 9 to FIG. 12, the holder 64 of the moving mechanism 26 is rotatable between a first holding position (refer to FIG. 9 and FIG. 10) where the holder 64 holds the transmitter 25 in the first position and a second holding position (refer to FIG. 11 and FIG. 12) where the holder 64 holds the transmitter 25 in the second position, in a state where the toner container 15 is detached from the attachment part 16. An arrow RD2 suitably shown in each figure indicates a rotating direction of the holder 64 from the first holding position to the second holding position (hereinafter, called as "a rotating direction RD2"). The holder 64 moves along the left-and-right direction between the above first holding position and the above second holding position, in the state where the toner container 15 is attached to the attachment part 16.

With reference to FIG. 6, the holder 64 includes a base part 67, an arm part 68 extending linearly from an outer circumferential face of the base part 67 to an outside in a radial direction (a direction separated from the first rotation axis X) and a boss part 69 extending linearly from an outer end portion of the arm part 68 in the radial direction to the right side (the outside in the left-and-right direction).

The base part 67 of the holder 64 is formed in a cylindrical shape with the first rotation axis X as an axis center. Into an inner circumference of the base part 67, the pair of protruding pieces 58 of the transmitter 25 is rotatably inserted. Thereby, the base part 67 rotatably holds the transmitter 25. A left edge portion (an edge portion at the inside in the left-and-right direction) of the base part 67 comes into contact with the fixing piece 59 of the transmitter 25.

On the outer circumferential face of the base part 67 of the holder 64, a pair of guided parts 71 (only one of them, the one at a near side on the figure, is shown in FIG. 6) is protruded. Each guided part 71 includes an inclined piece 72 and a non-inclined piece 73 provided at a downstream side of the inclined piece 72 in the rotating direction RD2, and is formed in an approximate V-shape. The inclined piece 72 is inclined to the right side (the outside in the left-and-right direction) from an upstream side to the downstream side in the rotating direction RD2. The non-inclined piece 73 is provided along the rotating direction RD2.

With reference to FIG. 7 and FIG. 8, the coil spring 65 of the moving mechanism 26 is interposed between the supporter 24 and the transmitter 25. The coil spring 65 is attached to an outer circumference of the cylindrical piece 57 of the transmitter 25. The coil spring 65 presses the transmitter 25 to the right side (the outside in the left-and-right direction) to bias the transmitter 25 to the second position (refer to FIG. 8) and to bias the holder 64 to the second holding position (refer to FIG. 11 and FIG. 12).

With reference to FIG. 7 and FIG. 8, the cover 27 of the toner container 15 includes a plate-shaped main wall 75, a guide wall 76 and an engaging wall 77 which are arranged at a center side of the main wall 75 and a circumferential wall 78 arranged at an outer circumference side of the main wall 75.

The main wall 75 of the cover 27 is provided along a plane crossing the first rotation axis X. In a center portion of the main wall 75, a circular through hole 79 is provided. With reference to FIG. 2, in lower portions of the main wall 75 and the circumferential wall 78, a notch 80 is provided. Through the notch 80, the boss part 69 of the holder 64 is penetrated. Thereby, a tip end portion of the boss part 69 is exposed to the right side (the outside in the left-and-right direction) of the cover 27.

Figure 10:
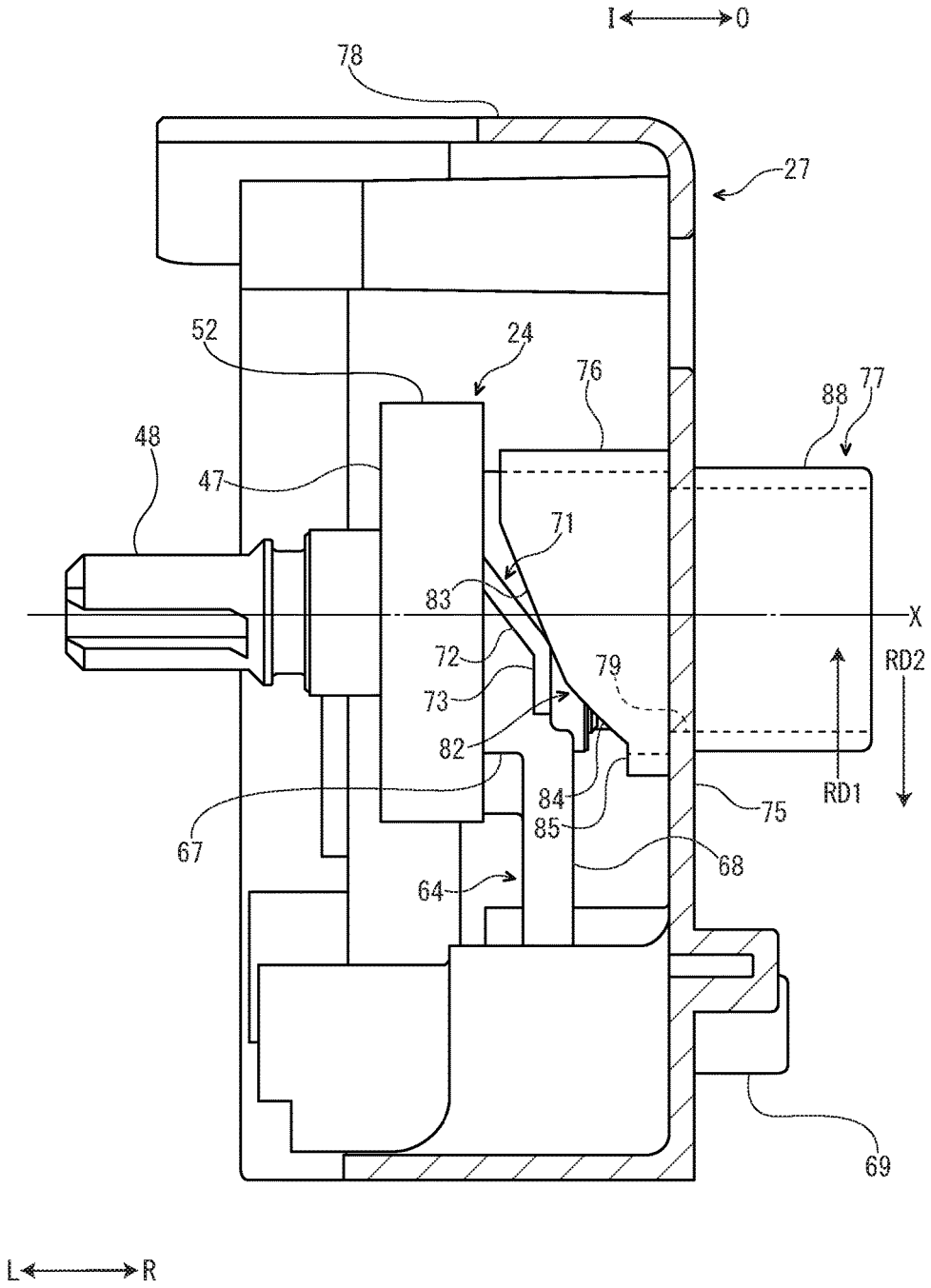
FIG. 10 is a sectional view taken along a line X-X of FIG. 9.
Figure 12:
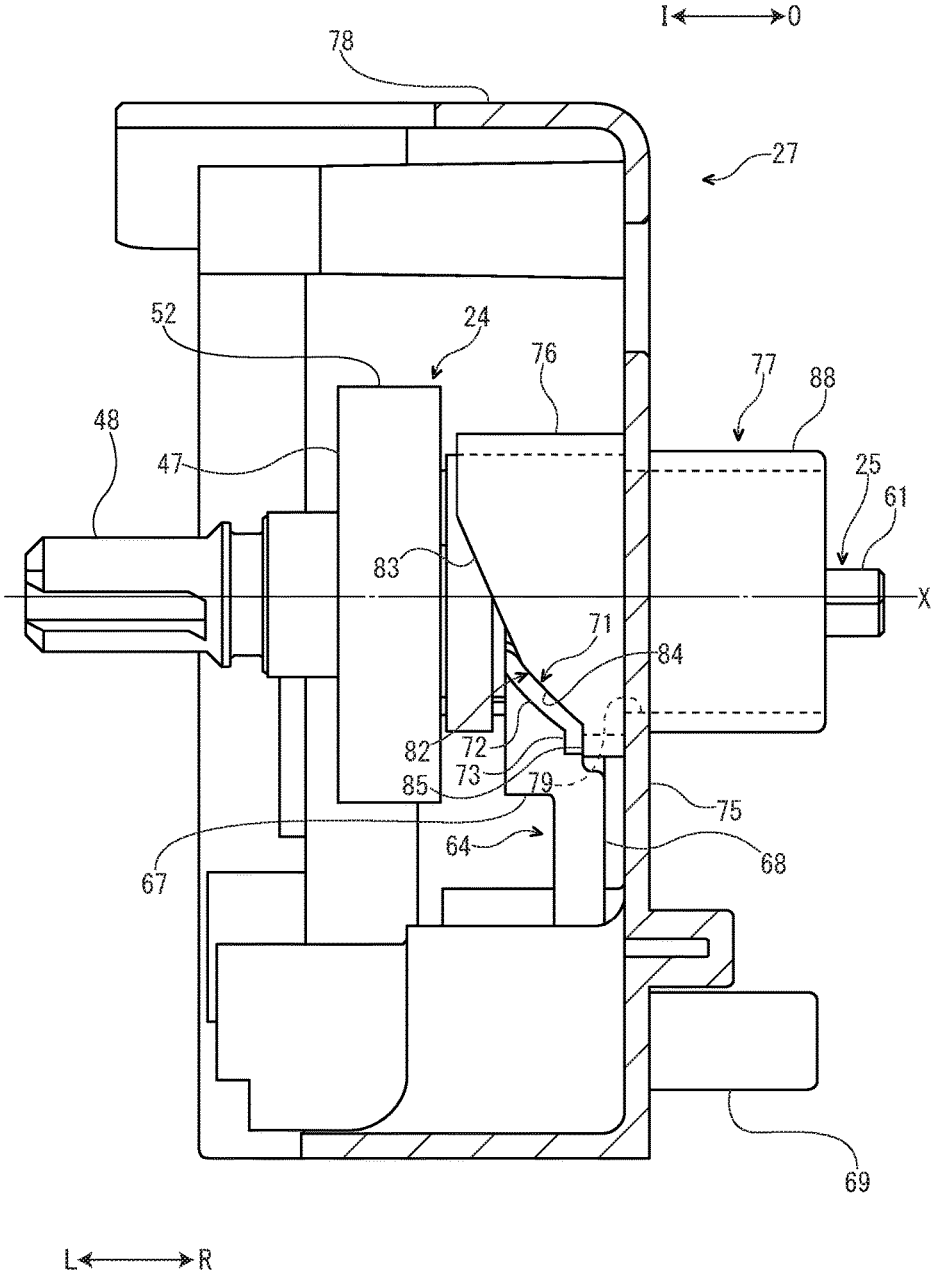
FIG. 12 is a sectional view taken along a line XII-XII of FIG. 11.

With reference to FIG. 10 and FIG. 12, the guide wall 76 of the cover 27 is formed in a cylindrical shape. The guide wall 76 is protruded from the main wall 75 at an outer circumference of the through hole 79 to the left side (the inside in the left-and-right direction). Into the guide wall 76, the base part 67 of the holder 64 is inserted. Thereby, the cover 27 rotatably supports the holder 64.

On a left edge portion (an edge portion at the inside in the left-and-right direction) of the guide wall 76 of the cover 27, a pair of guide parts 82 (only one of them, the one at the near side on the figure, is shown in FIG. 10 and FIG. 12) is provided. Each guide part 82 includes an upstream side inclined part 83, a downstream side inclined part 84 provided at the downstream side of the upstream side inclined part 83 in the rotating direction RD2 and a non-inclined part 85 provided at the downstream side of the downstream side inclined part 84 in the rotating direction RD2. The upstream side inclined part 83 and the downstream side inclined part 84 are inclined to the right side (the outside in the left-and-right direction) from the upstream side to the downstream side in the rotating direction RD2. An inclined degree of the upstream side inclined part 83 to the rotating direction RD2 is smaller than an inclined degree of the inclined piece 72 of each guided part 71 provided in the base part 67 of the holder 64 to the rotating direction RD2. An inclined degree of the downstream side inclined part 84 to the rotating direction RD2 is the same as the inclined degree of the inclined piece 72 to the rotating direction RD2. The non-inclined part 85 is provided along the rotating direction RD2.

Figure 9:
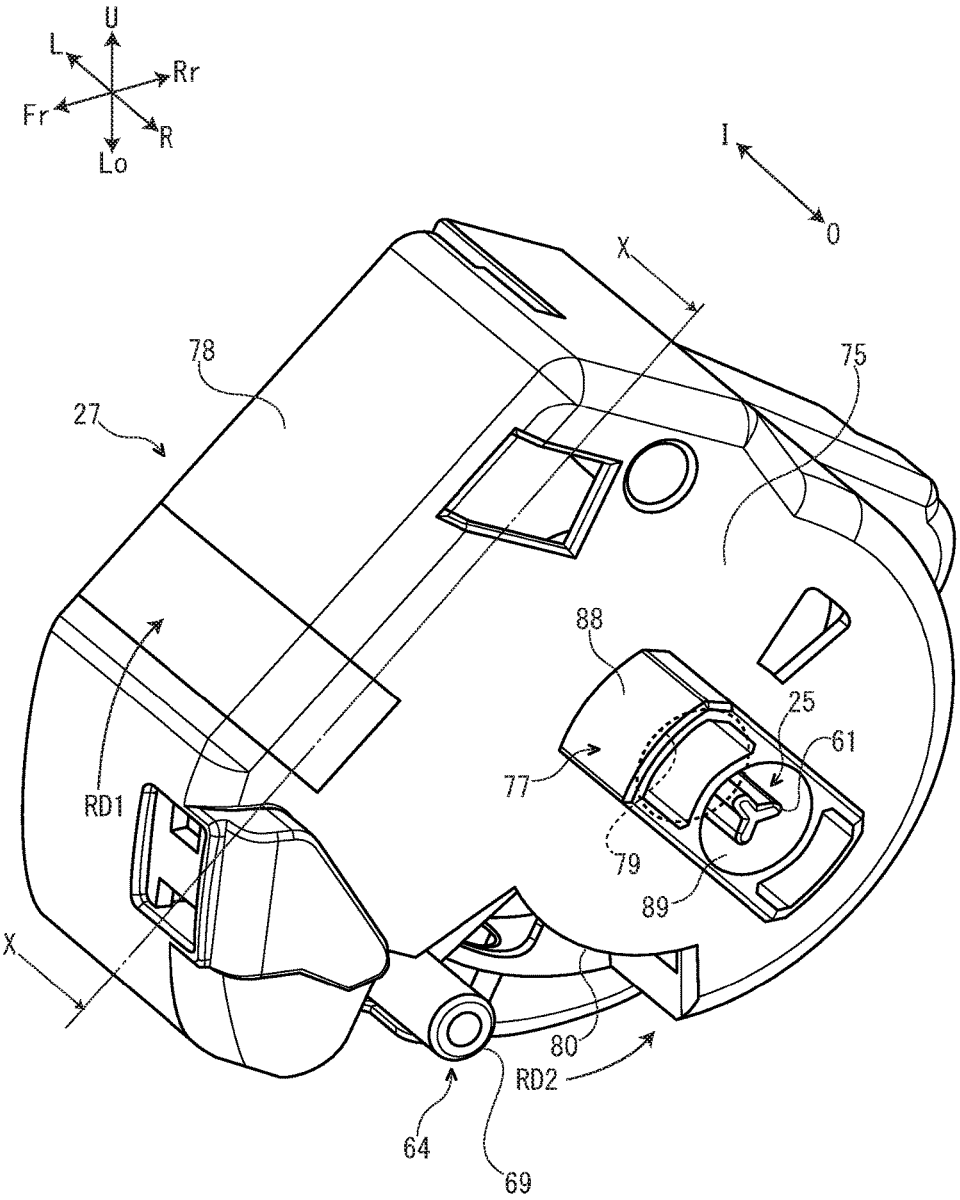
FIG. 9 is a perspective view showing a state where a holder is in a first holding position, in the toner container according to the first embodiment of the present disclosure.
Figure 11:
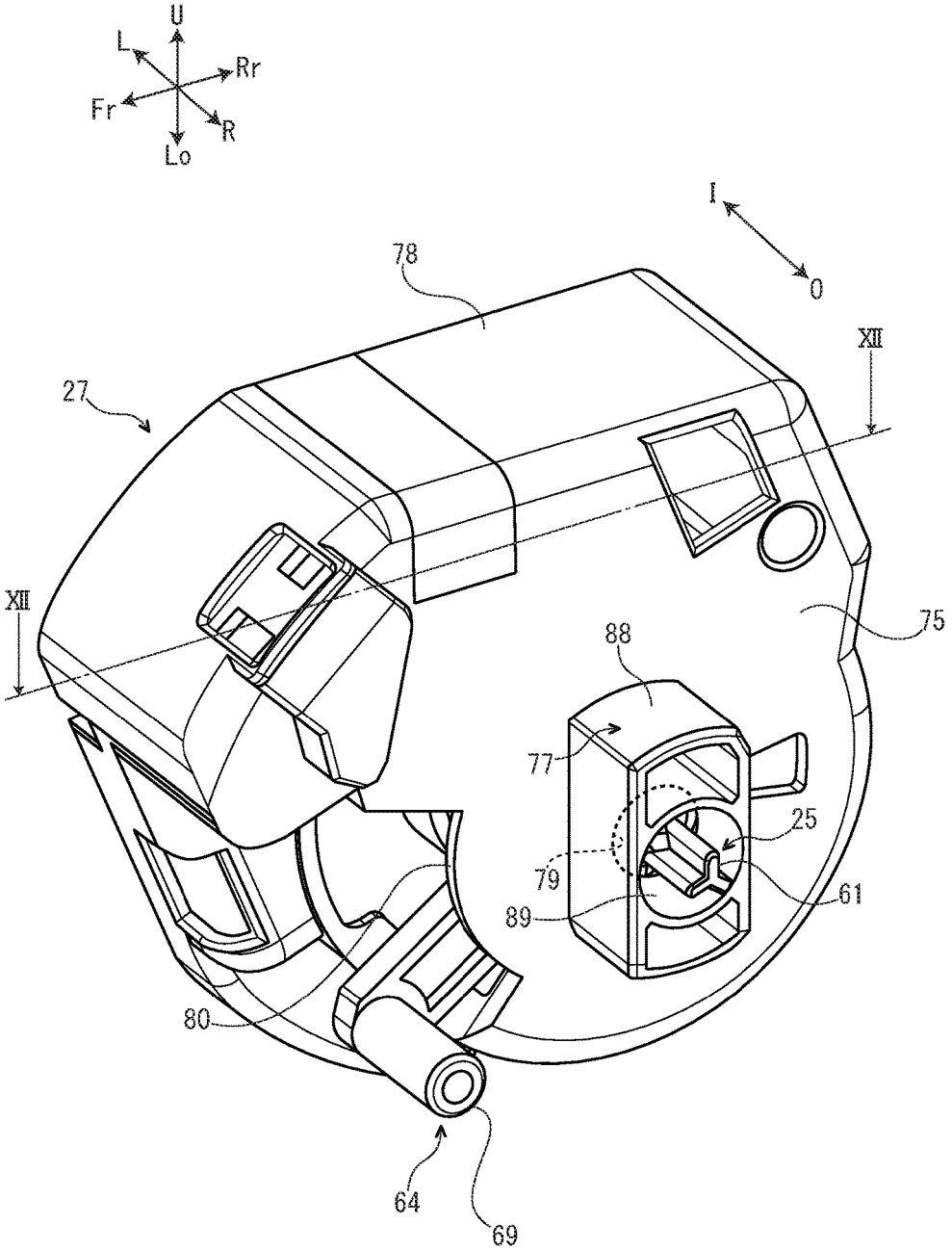
FIG. 11 is a perspective view showing a state where the holder is in a second holding position, in the toner container according to the first embodiment of the present disclosure.

With reference to FIG. 9 and FIG. 11, the engaging wall 77 of the cover 27 is protruded from the main wall 75 at the outer circumference of the through hole 79 to the right side (the outside in the left-and-right direction). The engaging wall 77 includes a square cylindrical shaped outer cylindrical part 88 and a cylindrical shaped inner cylindrical part 89 provided on an inner circumference of the outer cylindrical part 88.

With reference to FIG. 4 and FIG. 5, the shutter 28 of the toner container 15 is curved in an arc-shape along an outer face of the storage 31 of the case main body 21. The shutter 28 is capable of opening and closing the discharge port 33 of the storage 31.

With reference to FIG. 3, the connector 29 of the toner container 15 includes a connecting shaft 91 and a connecting gear 92 provided around an outer circumference of the connecting shaft 91. The connecting shaft 91 is penetrated through the right side wall 31R of the storage 31 of the case main body 21, and fixed to a right end portion of the conveying shaft 43 of the conveyer 23. The connecting gear 92 is arranged at the right side (the outside in the left-and-right direction) of the storage 31 of the case main body 21, and exposed to the outside of the case main body 21. The connecting gear 92 is connected to the driving gear 52 of the exposed piece 47 of the supporter 24 via an idle gear 93. According to the configuration described above, the supporter 24 is connected to the conveyer 23 via the idle gear 93 and the connector 29.

Next, the attachment part 16 will be described in detail.

Figure 13:
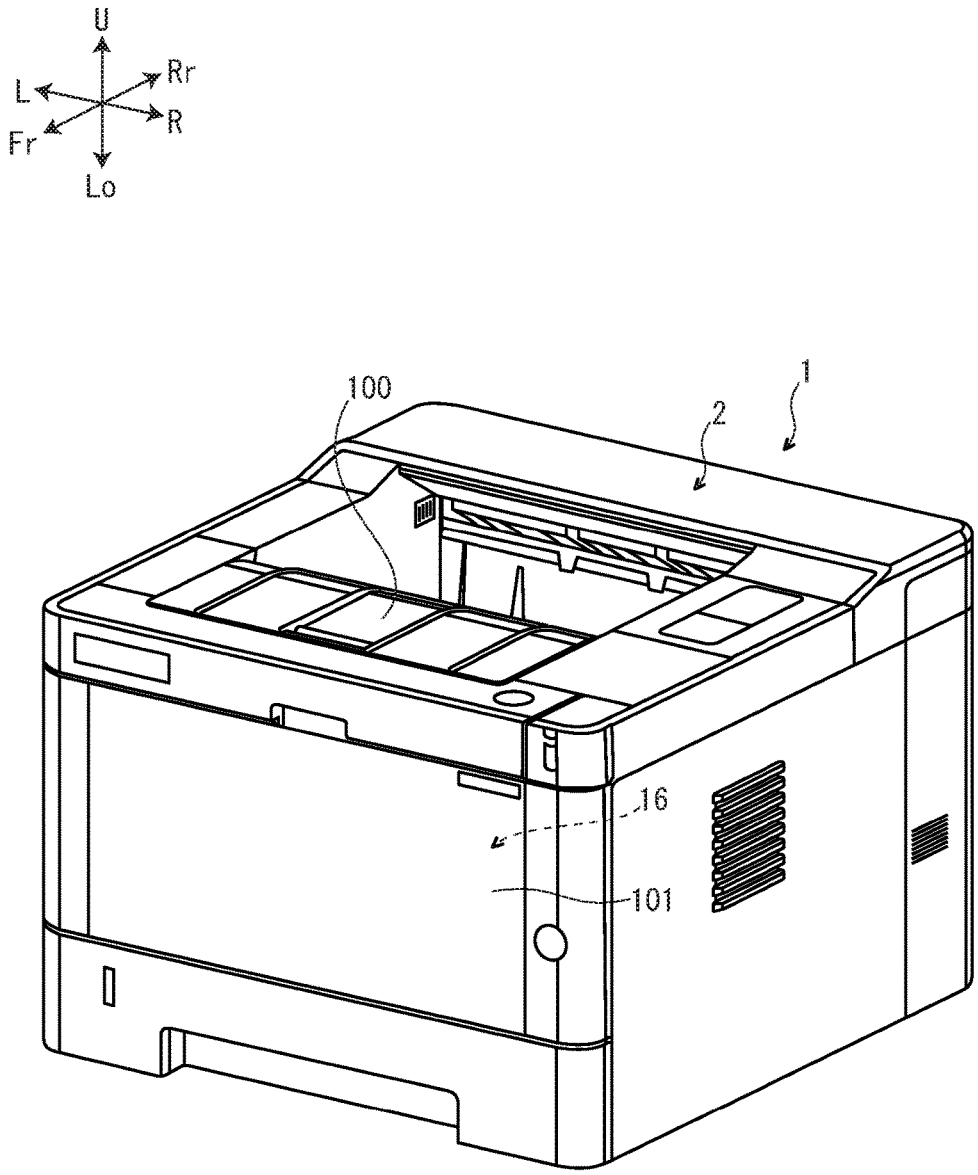
FIG. 13 is a perspective view showing a state where a top cover and a front cover are closed, in the printer according to the first embodiment of the present disclosure.
Figure 14:
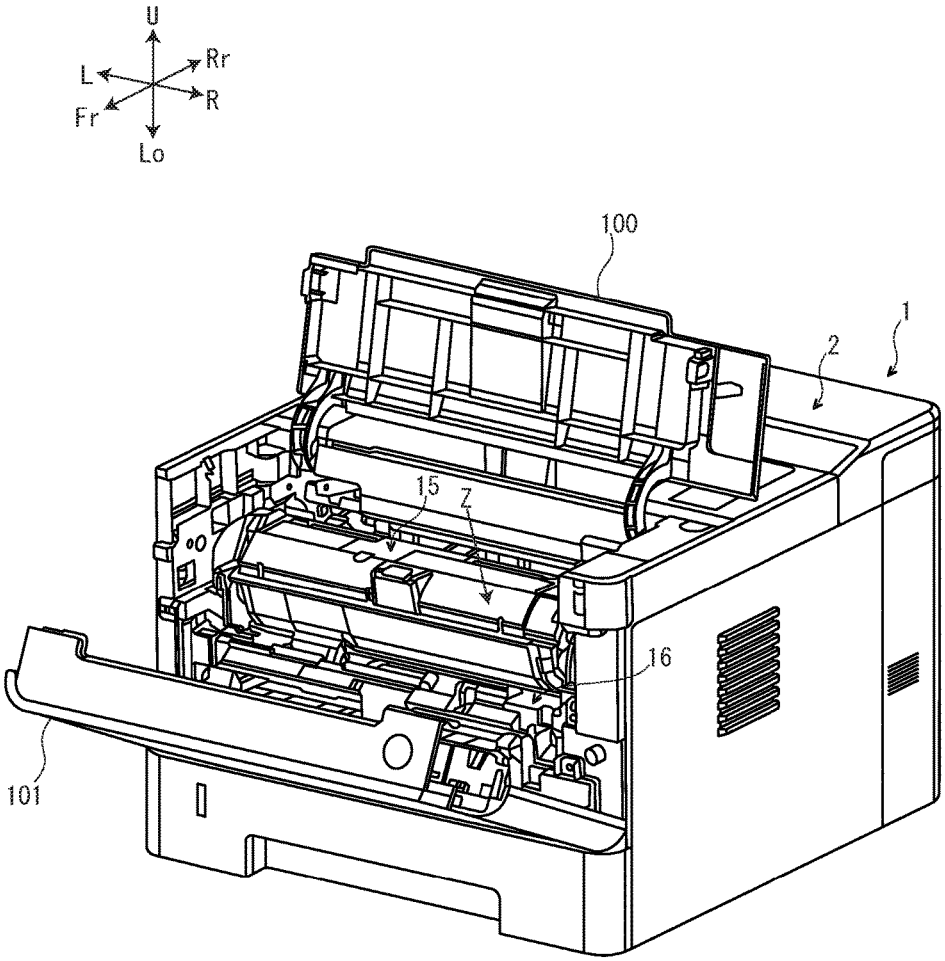
FIG. 14 is a perspective view showing a state where the top cover and the front cover are opened, in the printer according to the first embodiment of the present disclosure.

With reference to FIG. 13 and FIG. 14, an upper side of the attachment part 16 is covered with an openable and closable top cover 100, and a front side of the attachment part 16 is covered with an openable and closable front cover 101. By opening the top cover 100 and the front cover 101, it becomes possible to attach and detach the toner container 15 to and from the attachment part 16. With reference to FIG. 14, to the attachment part 16, the toner container 15 is detachably attached along an attachment direction Z from the upper side to the lower side.

Figure 15:
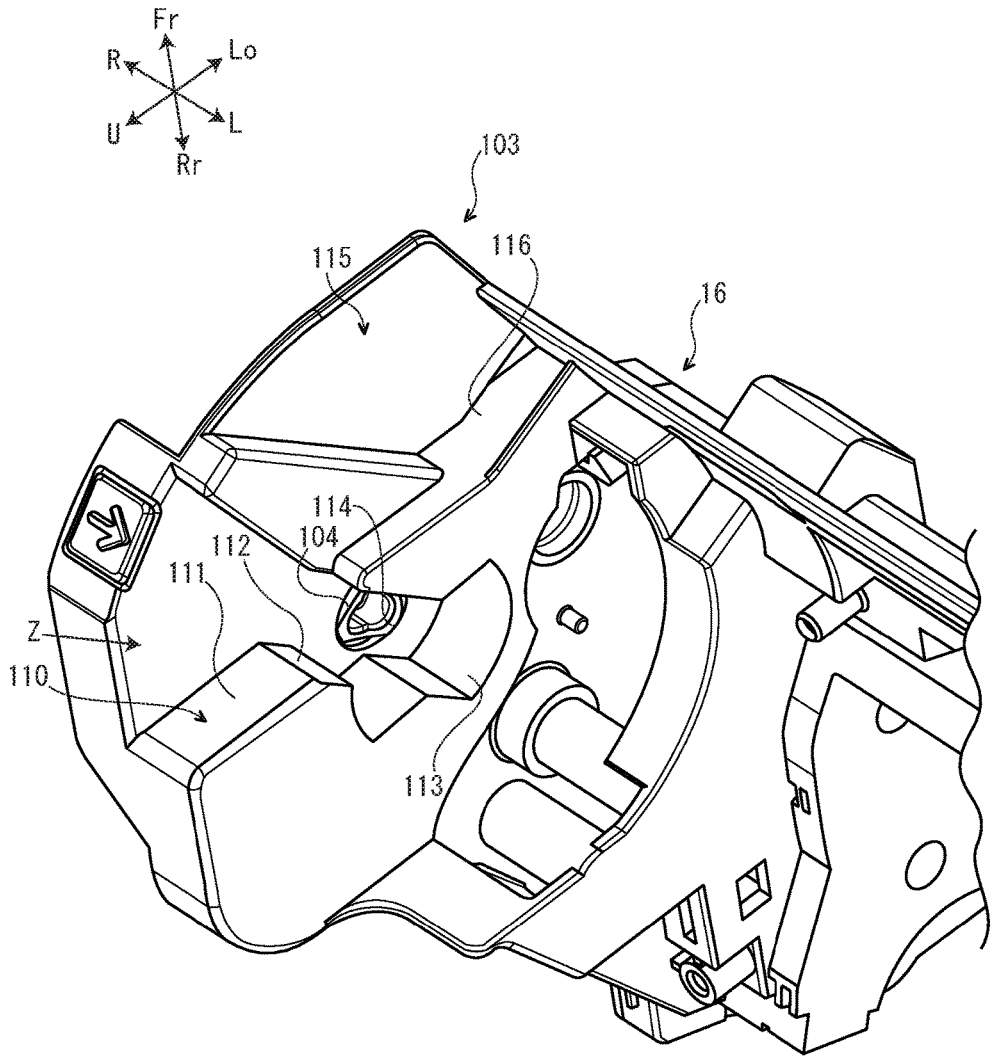
FIG. 15 is a perspective view showing the right side portion of the attachment part according to the first embodiment of the present disclosure.

With reference to FIG. 15, the attachment part 16 includes a pair of left and right frames 103 (only the right frame 103 is shown in FIG. 15) and a driving coupling 104 arranged in an approximate center portion of the right frame 103.

In an inner face of each frame 103 of the attachment part 16, an attachment groove 110 is provided. The attachment groove 110 has a first groove part 111, a second groove part 112 provided at a downstream side of the first groove part 111 in the attachment direction Z and a third groove part 113 provided at the downstream side of the second groove part 112 in the attachment direction Z. The first groove part 111 narrows toward the downstream side in the attachment direction Z. The second groove part 112 has a width narrower than the first groove part 111 and the third groove part 113.

In the inner face of the right frame 103, a communication hole 114 is provided at a position corresponding to the third groove part 113. In the inner face of the right frame 103, an insertion groove 115 is provided. On a face at the downstream side of the insertion groove 115 in the attachment direction Z, a restriction part 116 is provided.

With reference to FIG. 7 and FIG. 8, the driving coupling 104 of the attachment part 16 is exposed through the communication hole 114 of the right frame 103. The driving coupling 104 is rotatably supported by a holding member 118. The driving coupling 104 is connected to a driving source 119 constituted by a motor and the others.

Next, an operation to discharge the toner from the toner container 15 will be described.

With reference to FIG. 3, when the toner is discharged from the toner container 15, in a state where the transmitting coupling 61 of the transmitter 25 is coupled to the driving coupling 104 and the discharge port 33 of the storage 31 is opened, the driving source 119 is driven. When the driving source 119 is driven, the driving coupling 104 is rotated by rotation driving force from the driving source 119. When the driving coupling 104 is thus rotated, rotation of the driving coupling 104 is transmitted to the agitator 22 by the transmitter 25 and the supporter 24, and the agitator 22 is rotated. As a result, the toner stored in the storage 31 is agitated by the agitator 22.

When the driving coupling 104 is rotated as described above, the rotation is transmitted to the conveyer 23 by the transmitter 25, the supporter 24, the idle gear 93 and the connector 29, and the conveyer 23 is rotated. As a result, as shown in an arrow A in FIG. 3, the toner stored in the storage 31 is conveyed toward the discharge port 33 of the storage 31 by the conveyer 23. The toner thus conveyed toward the discharge port 33 of the storage 31 is discharged through the discharge port 33 of the storage 31 to the outside of the toner container 15. The toner discharged to the outside of the toner container 15 is replenished to the developing device 10 (refer to FIG.

Next, a work to check operation of the transmitter 25 by a worker, such as a user and a serviceman, will be described.

In the state where the toner container 15 is detached from the attachment part 16, the holder 64 is in the second holding position (refer to FIG. 11 and FIG. 12), and the inclined piece 72 and the non-inclined piece 73 of the guided part 71 of the holder 64 respectively come into contact with the downstream side inclined part 84 and the non-inclined part 85 of the guide part 82 of the cover 27. The transmitter 25 is held in the second position (refer to FIG. 8) by the holder 64, and the transmitting coupling 61 of the transmitter 25 protrudes to the right side (the outside in the left-and-right direction) further than the engaging wall 77 of the cover 27.

From this state, the worker presses the boss part 69 of the holder 64 to the upper side. Consequently, the holder 64 rotates with respect to the case main body 21 from the second holding position (refer to FIG. 11 and FIG. 12) to the first holding position (refer to FIG. 9 and FIG. 10) against biasing force of the coil spring 65. Consequently, the inclined piece 72 of the guided part 71 of the holder 64 moves along the downstream side inclined part 84 of the guide part 82 of the cover 27, and a boundary portion between the inclined piece 72 and the non-inclined piece 73 of the guided part 71 comes into contact with the upstream side inclined part 83 of the guide part 82. Consequently, the holder 64 moves to the left side (the inside in the left-and-right direction), and the transmitter 25 held by the holder 64 moves from the second position (refer to FIG. 8) to the first position (refer to FIG. 7). As a result, the transmitting coupling 61 of the transmitter 25 is retracted to an inside of the engaging wall 77 of the cover 27. In this state, an entire portion of the transmitter 25 is retracted to the inside of the cover 27.

Next, the worker releases the pressing of the boss part 69 of the holder 64. Consequently, the holder 64 rotates with respect to the case main body 21 from the first holding position (refer to FIG. 9 and FIG. 10) to the second holding position (refer to FIG. 11 and FIG. 12) by the biasing force of the coil spring 65. Consequently, the inclined piece 72 of the guided part 71 of the holder 64 moves along the downstream side inclined part 84 of the guide part 82 of the cover 27, and the inclined piece 72 and the non-inclined piece 73 of the guided part 71 respectively come into contact with the downstream side inclined part 84 and the non-inclined part 85 of the guide part 82. Consequently, the holder 64 moves to the right side (the outside in the left-and-right direction), and the transmitter 25 held by the holder 64 moves from the first position (refer to FIG. 7) to the second position (refer to FIG. 8). As a result, the transmitting coupling 61 of the transmitter 25 protrudes to the right side (the outside in the left-and-right direction) further than the engaging wall 77 of the cover 27.

As described above, in the present embodiment, as the holder 64 rotates with respect to the case main body 21, the transmitter 25 moves between the first position and the second position. By applying such a configuration, it becomes possible to move the transmitter 25 in the left-and-right direction by a simple operation. Accordingly, the worker is allowed to easily check whether the transmitter 25 is normally operated.

Next, an operation to set the toner container 15 to the attachment part 16 by a worker, such as a user and a serviceman, will be described.

In the state where the toner container 15 is detached from the attachment part 16, the holder 64 is in the second holding position (refer to FIG. 11 and FIG. 12), and the inclined piece 72 and the non-inclined piece 73 of the guided part 71 of the holder 64 respectively come into contact with the downstream side inclined part 84 and the non-inclined part 85 of the guide part 82 of the cover 27. The transmitter 25 is held in the second position (refer to FIG. 8) by the holder 64, and the transmitting coupling 61 of the transmitter 25 protrudes to the right side (the outside in the left-and-right direction) further than the engaging wall 77 of the cover 27. The shutter 28 closes the discharge port 33 of the storage 31.

Figure 16:
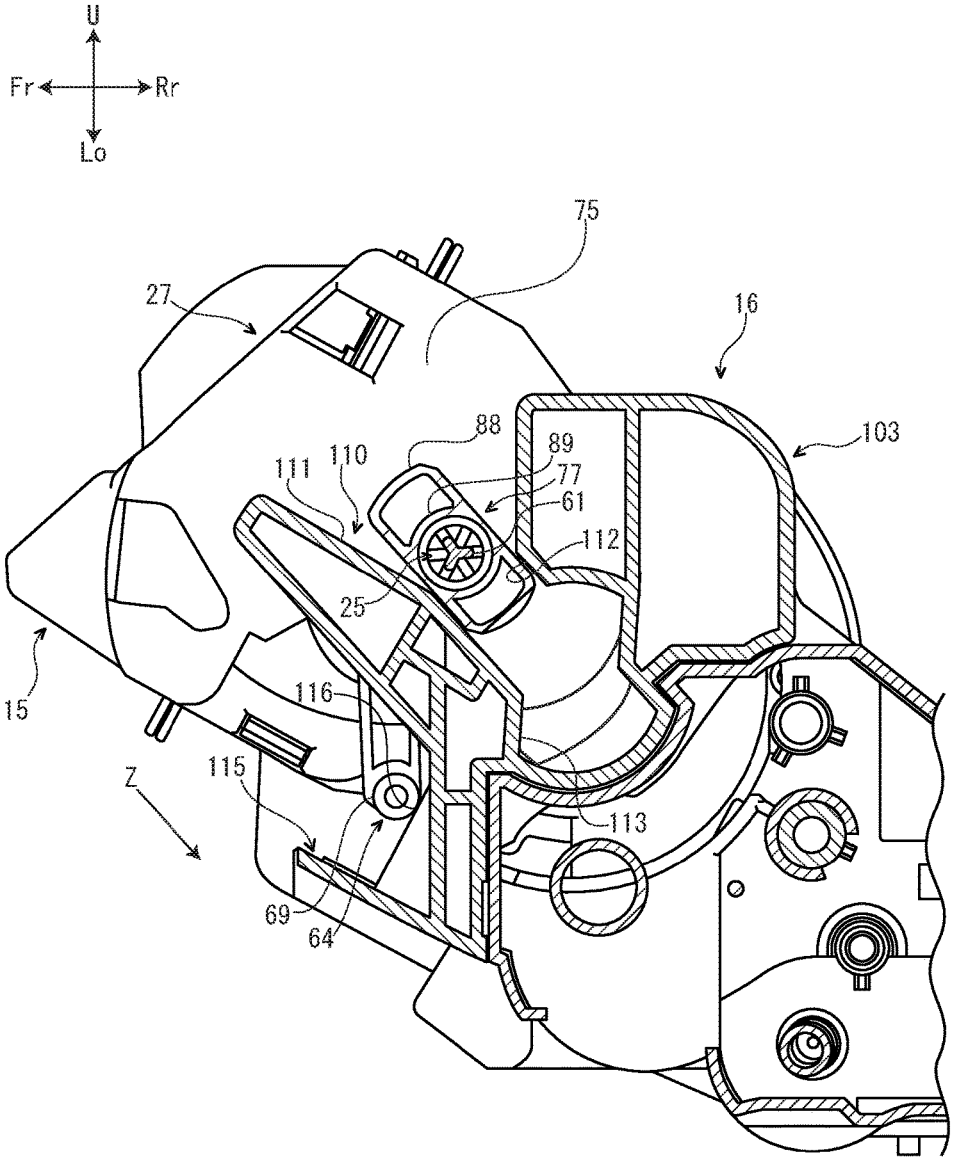
FIG. 16 is a sectional view showing a state where the toner container is inserted to a predetermined position of the attachment part, in the printer according to the first embodiment of the present disclosure.

When the worker sets the toner container 15 to the attachment part 16, as shown in FIG. 2, the worker inserts the toner container 15 to the attachment part 16 along the attachment direction Z. As shown in FIG. 16, when the toner container 15 is inserted to a predetermined position in the attachment part 16, the restriction part 116 provided in the insertion groove 115 comes into contact with the boss part 69 of the holder 64. This restricts rotation of the holder 64.

Figure 17:
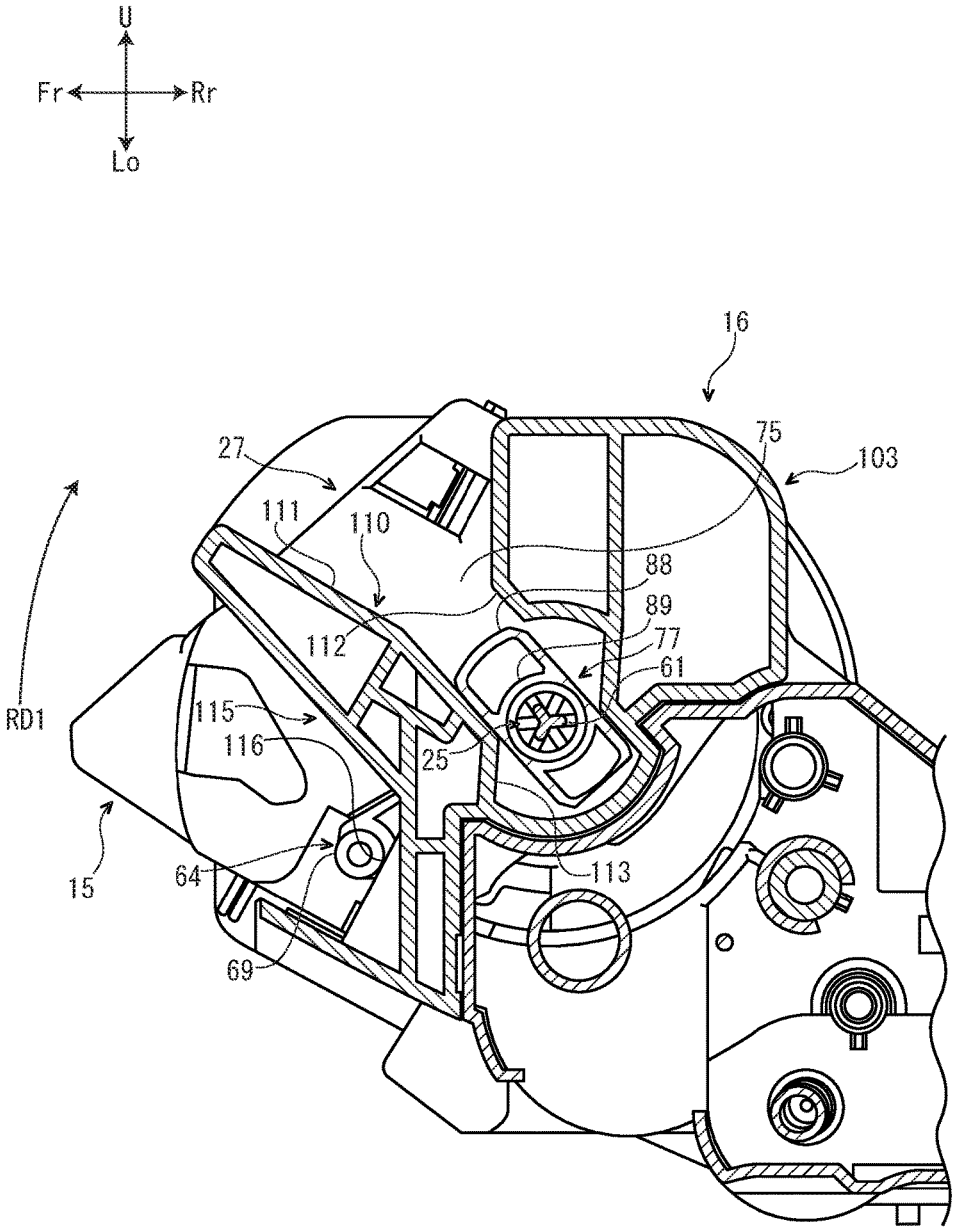
FIG. 17 is a sectional view showing a state where the toner container is attached to the attachment part and the case main body is in the first rotating position, in the printer according to the first embodiment of the present disclosure.

From this state, when the worker further inserts the toner container 15 to the attachment part 16 along the attachment direction Z, as shown in FIG. 17, the toner container 15 is attached to the attachment part 16. Consequently, the restriction part 116 provided in the insertion groove 115 of the attachment part 16 presses the boss part 69 of the holder 64, and the holder 64 moves from the second holding position (refer to FIG. 11 and FIG. 12) to the first holding position (refer to FIG. 9 and FIG. 10) against the biasing force of the coil spring 65. Consequently, the inclined piece 72 of the guided part 71 of the holder 64 moves along the downstream side inclined part 84 of the guide part 82 of the cover 27, and the boundary portion between the inclined piece 72 and the non-inclined piece 73 of the guided part 71 comes into contact with the upstream side inclined part 83 of the guide part 82. Consequently, the holder 64 moves to the left side (the inside in the left-and-right direction), and the transmitter 25 held by the holder 64 moves from the second position (refer to FIG. 8) to the first position (refer to FIG. 7). As a result, the transmitting coupling 61 of the transmitter 25 is retracted to the inside of the engaging wall 77 of the cover 27 and faces the driving coupling 104.

Additionally, as the toner container 15 is attached to the attachment part 16 as described above, as shown in FIG. 17, the engaging wall 77 of the cover 27 passes through the first groove part 111 and the second groove part 112, and is engaged with the third groove part 113 of the attachment groove 110 of the right frame 103. Meanwhile, the engaging part 34 of the case main body 21 passes through the first groove part 111 and the second groove part 112, and is engaged with the third groove part 113 of the attachment groove 110 of the left frame 103 (not shown in figures).

Next, in the state where the restriction part 116 comes into contact with the boss part 69 of the holder 64 and the rotation of the holder 64 is restricted, the worker rotates the case main body 21 with respect to the holder 64 from the first rotating position (refer to FIG. 4) to the second rotating position (refer to FIG. 5) along the rotating direction RD1. As a result, the shutter 28 opens the discharge port 33 of the storage 31.

Figure 18:
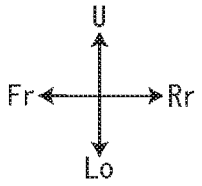
FIG. 18 is a sectional view showing a state where the toner container is attached to the attachment part and the case main body is in the second rotating position, in the printer according to the first embodiment of the present disclosure.
Figure 18:
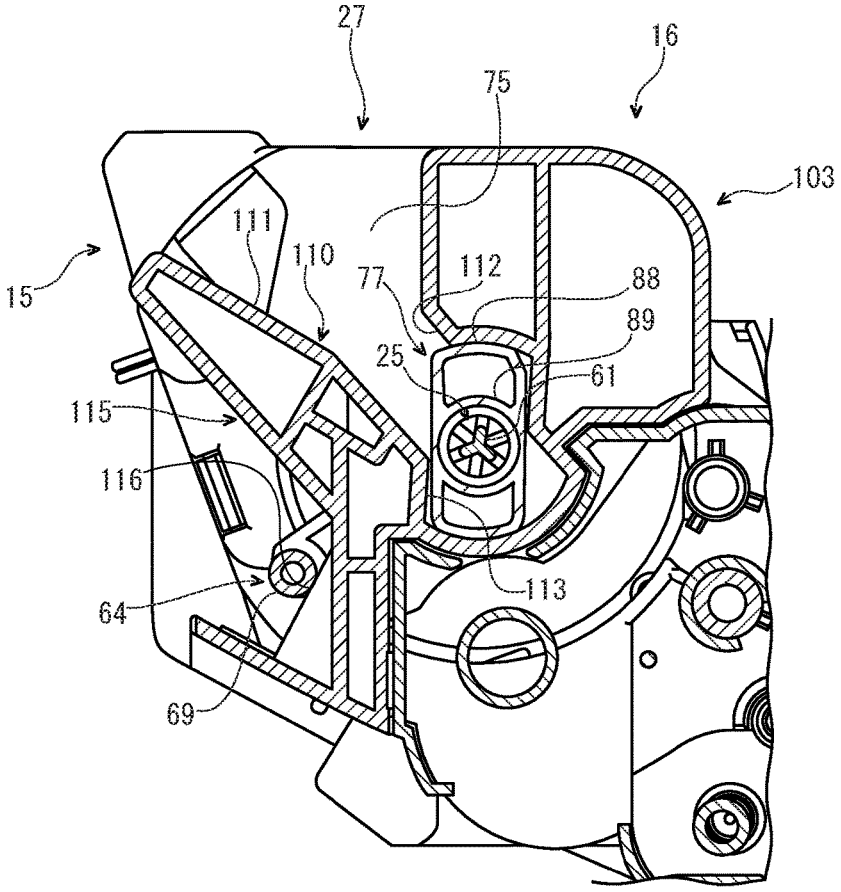

Additionally, as the case main body 21 is rotated from the first rotating position to the second rotating position as described above, the cover 27 rotates integrally with the case main body 21. Consequently, as shown in FIG. 18, the pressing of the holder 64 to the first holding position (refer to FIG. 9 and FIG. 10) by the restriction part 116 is released, and the holder 64 moves from the first holding position (refer to FIG. 9 and FIG. 10) to the second holding position (refer to FIG. 11 and FIG. 12) by the biasing force of the coil spring 65. Consequently, the inclined piece 72 of the guided part 71 of the holder 64 moves along the downstream side inclined part 84 of the guide part 82 of the cover 27, and the inclined piece 72 and the non-inclined piece 73 of the guided part 71 respectively come into contact with the downstream side inclined part 84 and the non-inclined part 85 of the guide part 82. Consequently, the holder 64 moves to the right side (the outside in the left-and-right direction), and the transmitter 25 held by the holder 64 moves from the first position (refer to FIG. 7) to the second position (refer to FIG. 8). As a result, the transmitting coupling 61 of the transmitter 25 protrudes to the right side (the outside in the left-and-right direction) further than the engaging wall 77 of the cover 27, and is coupled to the driving coupling 104.

Additionally, as the case main body 21 is rotated from the first rotating position to the second rotating position as described above, as shown in FIG. 17 and FIG. 18, the engaging wall 77 of the cover 27 rotates in the third groove part 113 of the attachment groove 110 of the right frame 103. Meanwhile, the engaging part 34 of the case main body 21 rotates in the third groove part 113 of the attachment groove 110 of the left frame 103 (not shown in figures). Thereby, the engaging wall 77 and the engaging part 34 are restricted from being removed from the attachment grooves 110 of the frames 103, and the toner container 15 is restricted from being detached from the attachment part 16. By the above operation, the setting of the toner container 15 to the attachment part 16 is completed.

When the toner container 15 is detached from the attachment part 16, the worker rotates the case main body 21 from the second rotating position (refer to FIG. 5) to the first rotating position (refer to FIG. 4) and then pulls out the toner container 15 from the attachment part 16 along a direction opposite to the attachment direction Z.

In the present embodiment, as described above, the toner container 15 includes the moving mechanism 26 which moves the transmitter 25 between the first position and the second position which is arranged at the right side (the outside in the left-and-right direction) of the first position. By the moving mechanism 26, as the case main body 21 is rotated from the first rotating position to the second rotating position, the transmitter 25 is moved from the first position to the second position. By applying such a configuration, it becomes possible to move the transmitter 25 to the right side by a simple operation and to reduce a worker's load for the attachment and detachment work of the toner container 15.

The moving mechanism 26 includes the holder 64 which rotates between the first holding position where the holder 64 holds the transmitter 25 in the first position and the second holding position where the holder 64 holds the transmitter 25 in the second position. By applying such a configuration, it becomes possible to make the moving mechanism 26 to be a simple structure.

The base part 67 of the holder 64 is inserted in the guide wall 76 of the cover 27. By applying such a configuration, it becomes possible to rotatably support the holder 64 by the cover 27 by using a simple structure.

The upstream side inclined part 83 and the downstream side inclined part 84 of the guide part 82 of the cover 27 are inclined to the right side (the outside in the left-and-right direction) from the upstream side to the downstream side in the rotating direction RD2, and the holder 64 includes the guided part 71 coming into contact with the upstream side inclined part 83 and the downstream side inclined part 84. By applying such a configuration, it becomes possible to move the holder 64 in the left-and-right direction surely as the cover 27 is rotated.

The transmitter 25 is supported by the supporter 24 in the state where the transmitter 25 is movable along the left-and-right direction and is not rotatable with respect to the supporter 24, and the coil spring 65 is interposed between the supporter 24 and the transmitter 25. By applying such a configuration, it becomes possible to integrate the supporter 24, the transmitter 25 and the coil spring 65 and to arrange them in a narrow space.

The printer 1 includes the toner container 15 and the attachment part 16 to which the toner container 15 is detachably attached. By applying such a configuration, it becomes possible to replace the toner container 15 easily.

By the way, in some cases, with an opening and closing operation of the top cover 100 provided in the printer main body 2 or the attachment operation of the toner container 15 to the attachment part 16, the driving coupling 104 is moved to be coupled to the transmitting coupling 61. However, to achieve such a configuration, the attachment part 16 requires a driving mechanism to move the driving coupling 104, and therefore, the attachment part 16 may be complicated in its structure.

However, in the present embodiment, as the case main body 21 is rotated from the first rotating position to the second rotating position in the state where the toner container 15 is attached to the attachment part 16, the moving mechanism 26 moves the transmitter 25 from the first position to the second position, and the transmitting coupling 61 is coupled to the driving coupling 104. By applying such a configuration, the attachment part 16 does not require the driving mechanism to move the driving coupling 104 so that it becomes possible to suppress the complication of the structure of the attachment part 16 and to achieve space saving of the printer main body 2.

Additionally, as the toner container 15 is attached to the attachment part 16, the restriction part 116 provided in the attachment part 16 presses the holder 64, and the holder 64 moves from the second holding position to the first holding position against the biasing force of the coil spring 65. In the state where the toner container 15 is attached to the attachment part 16, as the case main body 21 is rotated from the first rotating position to the second rotating position, the pressing of the holder 64 to the first holding position by the restriction part 116 is released, and the holder 64 moves from the first holding position to the second holding position by the biasing force of the coil spring 65. By applying such a configuration, it becomes possible to move the holder 64 between the first holding position and the second holding position by using a simple structure.

In the present embodiment, entire parts of the agitator 22 and the conveyer 23 are stored in the case main body 21. On the other hand, in another embodiment, parts of the agitator 22 and/or the conveyer 23 may be stored in the case main body 21.

In the present embodiment, an entire part of the transmitter 25 is arranged outside the case main body 21. On the other hand, in another embodiment, apart of the transmitter 25 may be arranged outside the case main body 21.

In the present embodiment, the configuration of the present disclosure is applied to the printer 1. On the other hand, in another embodiment, the configuration of the present disclosure may be applied to an image forming apparatus, such as a copying machine, a facsimile and a multifunctional peripheral, other than the printer 1.

A Second Embodiment

Hereinafter, a second embodiment of the present disclosure will be described with reference to FIG. 19 to FIG. 22.

Firstly, the toner container 151 according to the second embodiment will be described. The same configurations as the toner container 15 according to the first embodiment are not explained.

Figure 19:
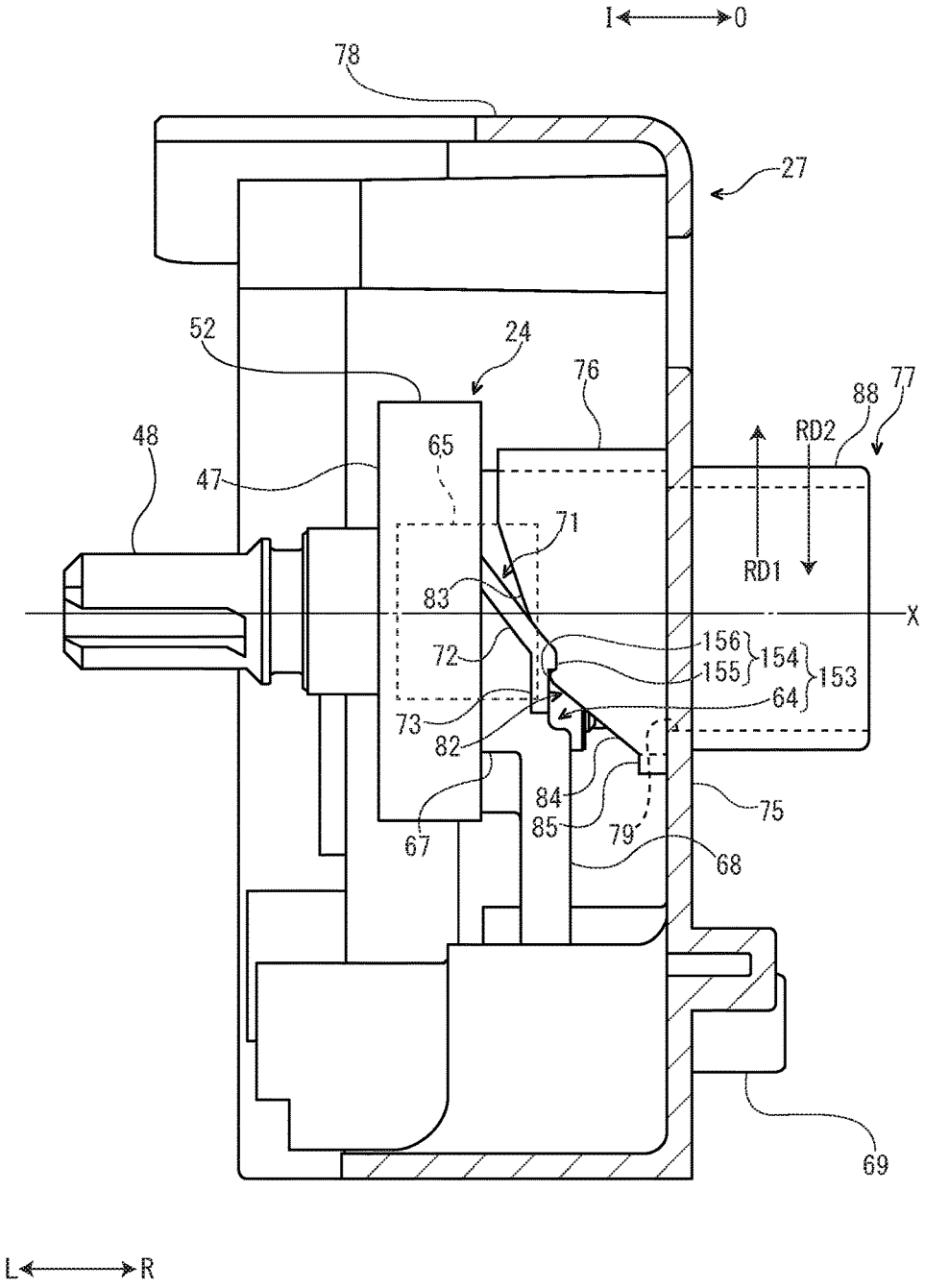
FIG. 19 is a sectional view showing a state where the holder is in the first holding position, in the toner container according to a second embodiment of the present disclosure.
Figure 20:
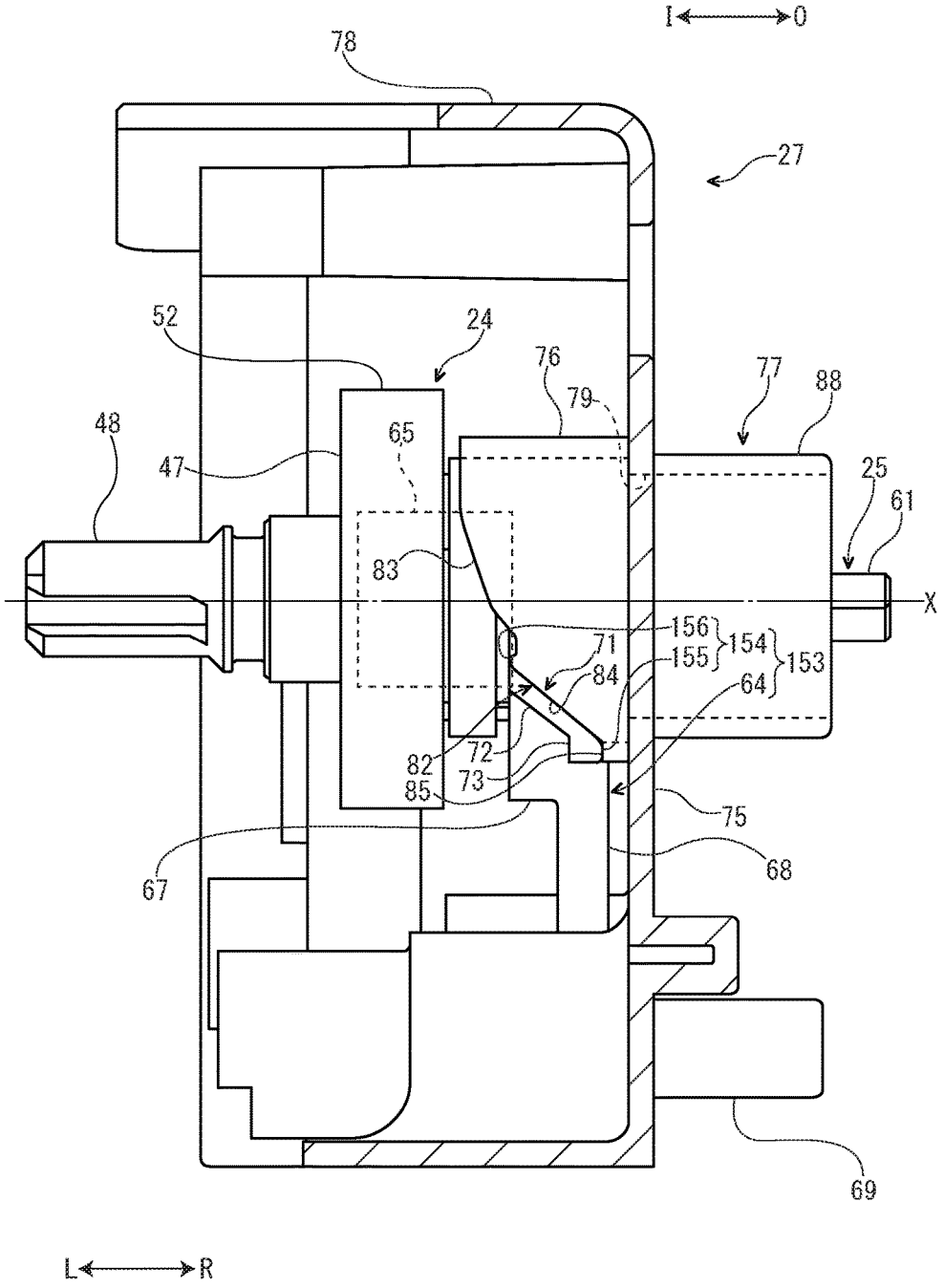
FIG. 20 is a sectional view showing a state where the holder is in the second holding position, in the toner container according to the second embodiment of the present disclosure.

With reference to FIG. 19 and FIG. 20, the moving mechanism 153 of the toner container 151 includes a locking mechanism 154, in addition to the holder 64 and the coil spring 65. The locking mechanism 154 includes a pair of first projections 155 (only one of them, the one at the near side on the figure, is shown in FIG. 19 and FIG. 20) and a pair of second projections 156 (only one of them, the one at the near side on the figure, is shown in FIG. 19 and FIG. 20). Each first projection 155 is protruded from each guided part 71 of the holder 64 to the right side (the outside in the left-and-right direction). Each second projection 156 is protruded from each guide part 82 of the cover 27 to the left side (the inside in the left-and-right direction).

Next, the attachment part 152 according to the second embodiment will be described. The same configurations as the attachment part 16 according to the first embodiment are not explained.

Figure 21:
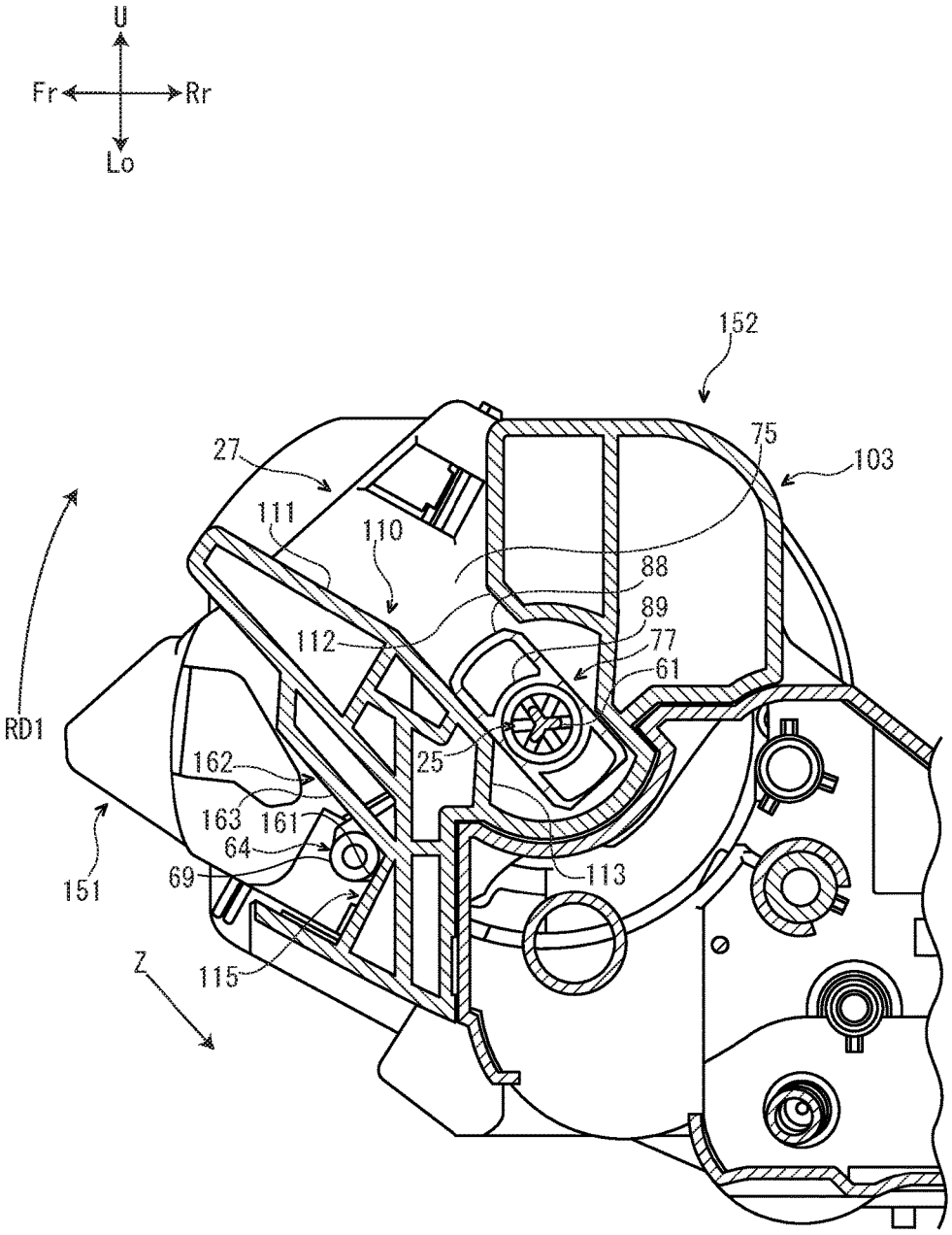
FIG. 21 is a sectional view showing a state where the case main body of the toner container is in the first rotating position, in the printer according to the second embodiment of the present disclosure.
Figure 22:
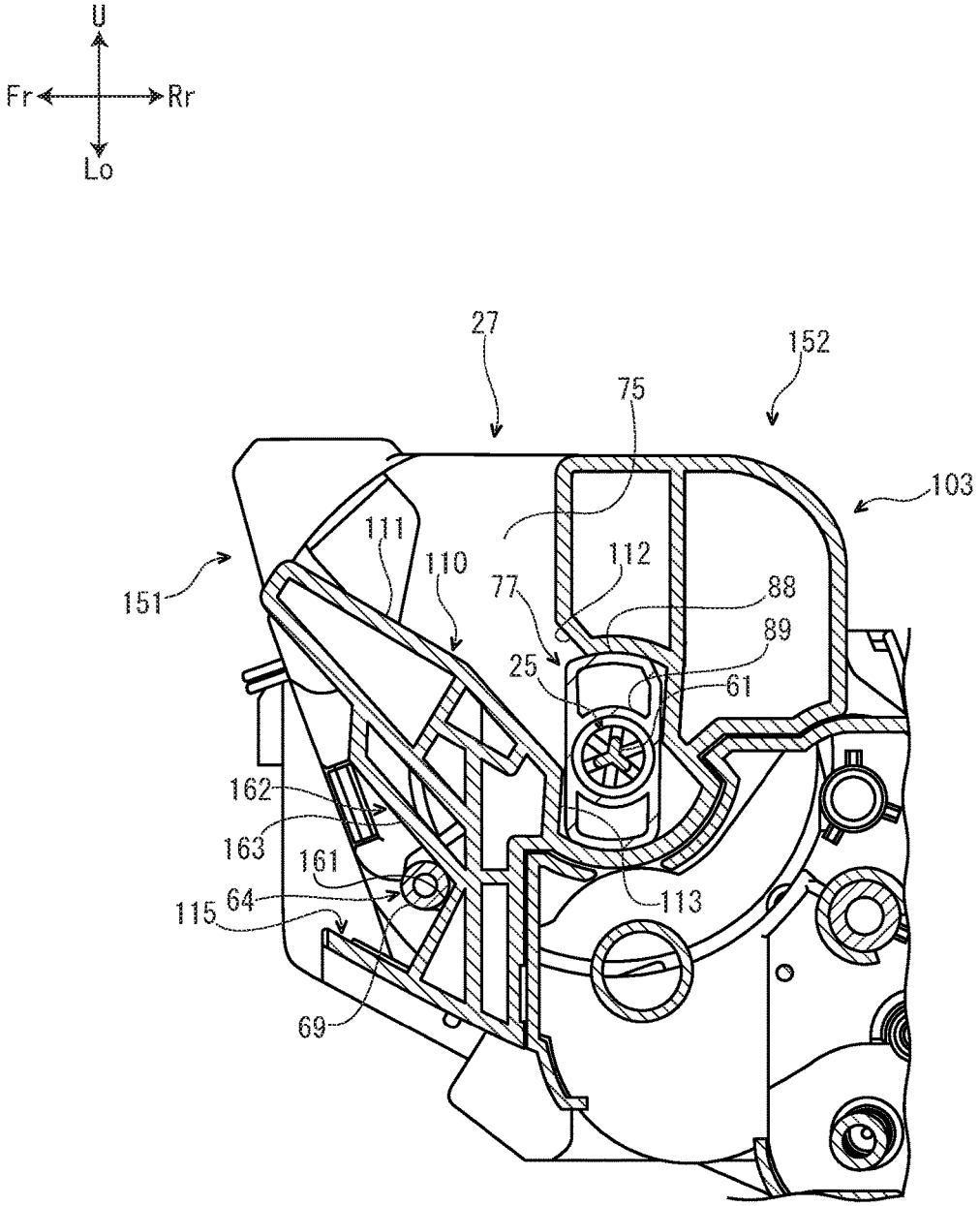
FIG. 22 is a sectional view showing a state where the case main body of the toner container is in the second rotating position, in the printer according to the second embodiment of the present disclosure.

With reference to FIG. 21 and FIG. 22, in the inner face of the right frame 103 of the attachment part 152, the insertion groove 115 is provided. On the face at the downstream side in the attachment direction Z of the insertion groove 115, the restriction part 161 is provided. In the insertion groove 115, a pressing rib 162 extending along the attachment direction Z is provided adjacent to the restriction part 161. The pressing rib 162 includes a pressing face 163 at a rear upper side (the downstream side in the rotating direction RD1) of the restriction part 161.

Next, an operation to set the toner container 151 to the attachment part 152 by a worker, such as a user and a serviceman, will be described. The same operations as the first embodiment are not explained.

In the state where the toner container 151 is detached from the attachment part 152, each first projection 155 and each second projection 156 of the locking mechanism 154 are engaged with each other, and the holder 64 is held in the first holding position (refer to FIG. 19) against the biasing force of the coil spring 65. That is, the holder 64 is held in the first holding position by the locking mechanism 154. Thereby, the transmitting coupling 61 of the transmitter 25 is retracted to the inside of the engaging wall 77 of the cover 27.

When the worker sets the toner container 151 to the attachment part 152, the worker attaches the toner container 151 to the attachment part 152 along the attachment direction Z. Consequently, as shown in FIG. 21, the boss part 69 of the holder 64 comes into contact with the restriction part 161 and the pressing face 163 of the insertion groove 115 of the attachment part 152.

Next, the worker rotates the case main body 21 from the first rotating position to the second rotating position. Consequently, as shown in FIG. 22, the pressing face 163 of the insertion groove 115 presses the boss part 69. The pressing releases the engagement of each first projection 155 and each second projection 156 of the locking mechanism 154. That is, the holding of the holder 64 in the first holding position by the locking mechanism 154 is released. Consequently, the holder 64 rotates from the first holding position (refer to FIG. 19) to the second holding position (refer to FIG. 20) by the biasing force of the coil spring 65. Consequently, the holder 64 moves to the right side (the outside in the left-and-right direction), and the transmitter 25 held by the holder 64 moves from the first position to the second position. As a result, the transmitting coupling 61 of the transmitter 25 protrudes to the right side (the outside in the left-and-right direction) further than the engaging wall 77 of the cover 27 and is coupled to the driving coupling 104.

In the present embodiment, as described above, the toner container 151 includes the coil spring 65 biasing the holder 64 to the second holding position and the locking mechanism 154 holding the holder 64 to the first holding position against the biasing force of the coil spring 65. Therefore, in the state where the toner container 151 is detached from the attachment part 152, it becomes possible to hold the transmitter 25 in the first position by the holder 64 and to retract the transmitting coupling 61 of the transmitter 25 to the inside of the engaging wall 77 of the cover 27. Accordingly, it becomes possible to suppress the transmitting coupling 61 from being damaged by impact applied from the outside at transporting of the toner container 151.

Additionally, the locking mechanism 154 includes the first projection 155 provided in the holder 64 and the second projection 156 which is provided in the cover 27 and engaged with the first projection 155. By applying such a configuration, it becomes possible to constitute the locking mechanism 154 without adding dedicated members.

Additionally, in the state where the toner container 151 is attached to the attachment part 152, as the case main body 21 is rotated from the first rotating position to the second rotating position, the pressing face 163 provided in the attachment part 152 presses the holder 64, the holding of the holder 64 in the first holding position by the locking mechanism 154 is released, and the holder 64 moves from the first holding position to the second holding position by the biasing force of the coil spring 65. By applying such a configuration, it becomes possible to move the holder 64 from the first holding position to the second holding position surely.

A Third Embodiment

Hereinafter, a third embodiment of the present disclosure will be described with reference to FIG. 23 and FIG. 24.

The toner container 171 (an example of a toner case) according to the third embodiment includes a manipulation member 172, in addition to each component of the toner container 15 according to the first embodiment. In the toner container 171, the components other than the manipulation member 172 have the approximate same configurations as the toner container 15 according to the first embodiment, except that the boss part 69 of the holder 64 extends from an end portion at the outside in the radial direction of the arm part 68 to the left side (the inside in the left-and-right direction) and the shutter 28 is formed in a cylindrical shape, and their detail explanations are omitted.

The manipulation member 172 of the toner container 171 is arranged at the right side (the outside in the left-and-right direction) of the storage 31 of the case main body 21. That is, the manipulation member 172 is arranged outside the case main body 21. The manipulation member 172 is rotatable around the first rotation axis X between a first manipulating position (refer to FIG. 23) and a second manipulating position (refer to FIG. 24). The manipulation member 172 is connected to the shutter 28 via a gear mechanism (not shown).

The manipulation member 172 includes a main body part 173, a manipulated part 174 extending linearly from an outer circumferential face of the main body part 173 to an outside in a radial direction (a direction separated from the first rotation axis X) and a pressing part 175 extending linearly from the outer circumferential face of the main body part 173 to the outside in the radial direction (the direction separated from the first rotation axis X). The pressing part 175 is formed in a laterally laid U-shape. Into an inner circumference of the pressing part 175, the boss part 69 of the holder 64 is engaged.

In the toner container 171 having the above described configuration, in a state where the manipulation member 172 is arranged at the first manipulating position (refer to FIG. 23), the pressing part 175 of the manipulation member 172 presses the boss part 69 of the holder 64, and the holder 64 is held in the first holding position. Consequently, the transmitter 25 is held in the first position by the holder 64, and the transmitting coupling 61 of the transmitter 25 is retracted to an inside of the through hole 79 of the cover 27 (only a part of the cover 27 is shown in FIG. 23 and FIG. 24). The shutter 28 closes the discharge port 33 of the case main body 21.

Figure 23:
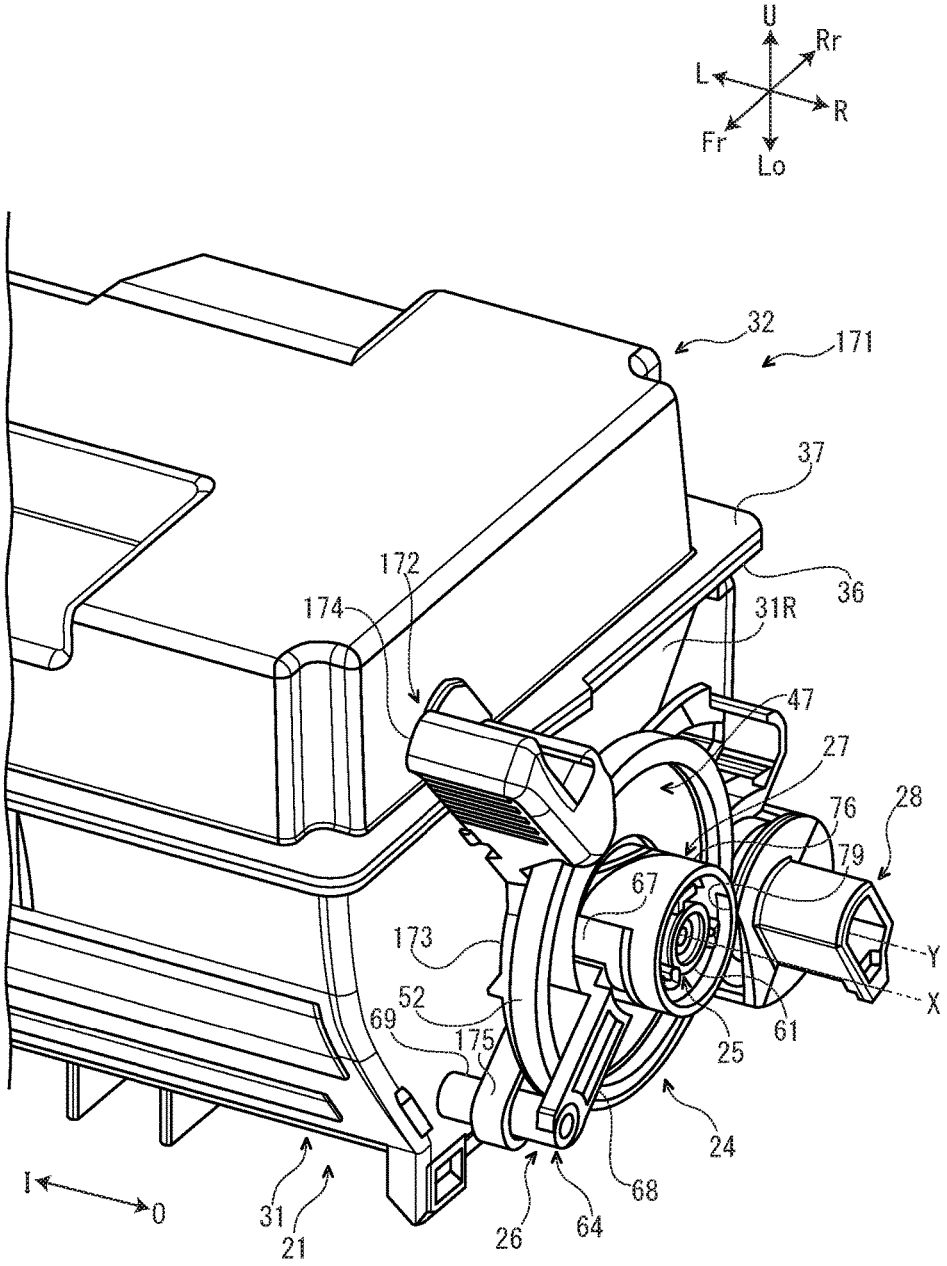
FIG. 23 is a perspective view showing a state where a manipulation member is in a first manipulating position, in the toner container according to a third embodiment of the present disclosure.
Figure 24:
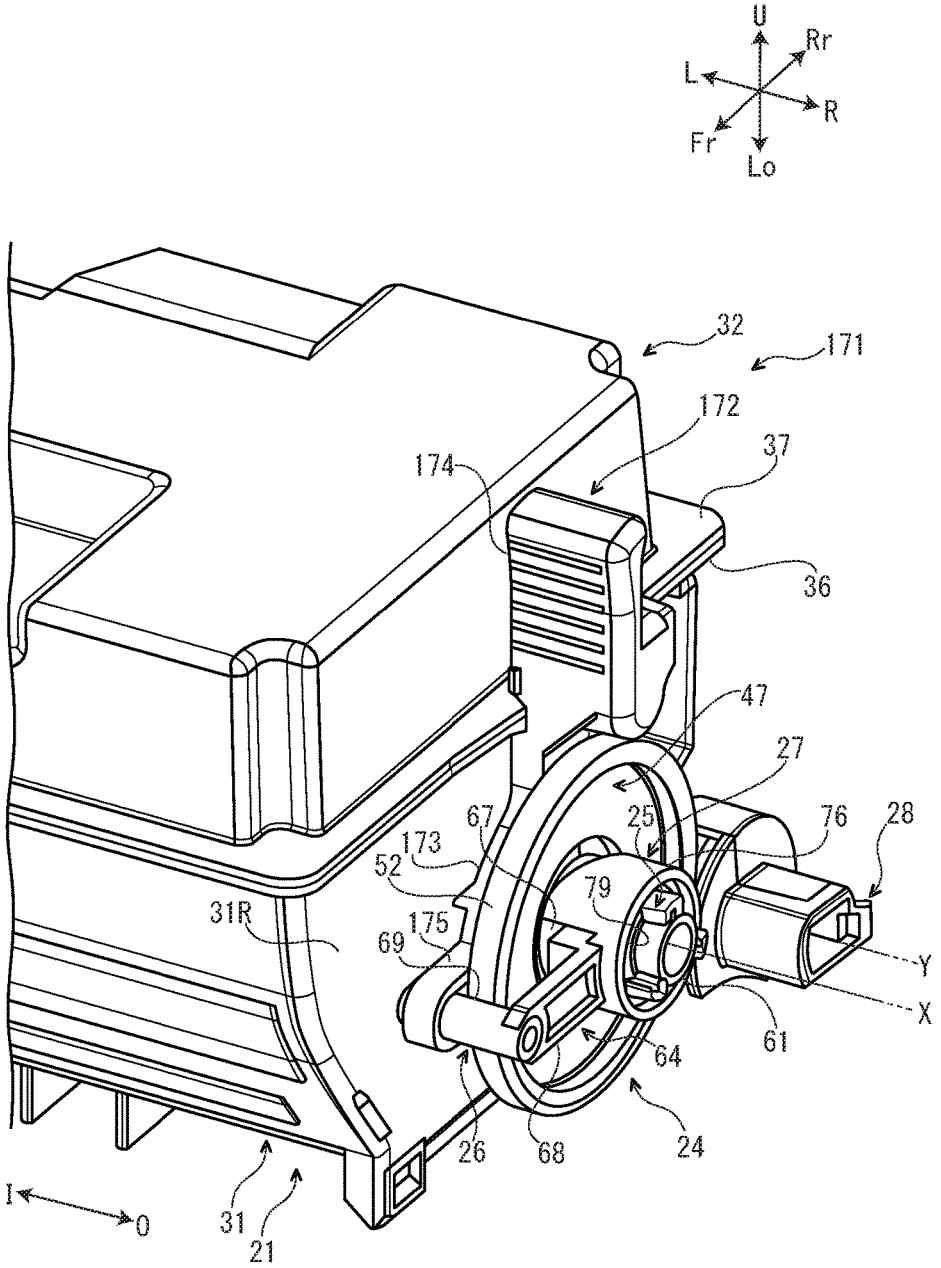
FIG. 24 is a perspective view showing a state where the manipulation member is in a second manipulating position, in the toner container according to the third embodiment of the present disclosure.

From this state, when a worker, such as a user and a serviceman, presses the manipulated part 174 of the manipulation member 172 to the rear side, the manipulation member 172 is rotated from the first manipulating position (refer to FIG. 23) to the second manipulating position (refer to FIG. 24). Consequently, the pressing of the holder 64 to the first holding position by the manipulation member 172 is released, and the holder 64 rotates with respect to the case main body 21 from the first holding position to the second holding position by the biasing force of the coil spring 65. Consequently, according to the same process as the first embodiment, the holder 64 moves to the right side (the outside in the left-and-right direction), and the transmitter 25 held by the holder 64 moves from the first position to the second position. As a result, the transmitting coupling 61 of the transmitter 25 protrudes to the right side (the outside in the left-and-right direction) further than the through hole 79 of the cover 27. Thereby, the transmitting coupling 61 is enabled to be coupled to the driving coupling 104.

When the manipulation member 172 is rotated from the first manipulating position (refer to FIG. 23) to the second manipulating position (refer to FIG. 24) as described above, the rotation of the manipulation member 172 is transmitted to the shutter 28, and the shutter 28 rotates. Thereby, the shutter 28 opens the discharge port 33 of the case main body 21.

From this state, when the worker presses the manipulated part 174 of the manipulation member 172 to the front side, the manipulation member 172 is rotated from the second manipulating position (refer to FIG. 24) to the first manipulating position (refer to FIG. 23). Consequently, the pressing part 175 of the manipulation member 172 presses the boss part 69 of the holder 64, and the holder 64 rotates with respect to the case main body 21 from the second holding position to the first holding position against the biasing force of the coil spring 65. Consequently, according to the same process as the first embodiment, the holder 64 moves to the left side (the inside in the left-and-right direction), and the transmitter 25 held by the holder 64 moves from the second position to the first position. As a result, the transmitting coupling 61 of the transmitter 25 is retracted to the inside of the through hole 79 of the cover 27. Thereby, the coupling of the transmitting coupling 61 to the driving coupling 104 is inhibited.

When the manipulation member 172 is rotated from the second manipulating position (refer to FIG. 24) to the first manipulating position (refer to FIG. 23) as described above, the rotation of the manipulation member 172 is transmitted to the shutter 28, and the shutter 28 rotates. As a result, the shutter 28 closes the discharge port 33 of the case main body 21.

In the present embodiment, as the manipulation member 172 is rotated between the first manipulating position and the second manipulating position, the holder 64 rotates between the first holding position and the second holding position. By applying such a configuration, it becomes possible to move the transmitter 25 along the left-and-right direction by a simple operation.

In the present embodiment, the manipulation member 172 rotates between the first manipulating position and the second manipulating position. On the other hand, in another embodiment, the manipulation member 172 may move linearly between the first manipulating position and the second manipulating position.

A Fourth Embodiment

Hereinafter, a fourth embodiment of the present disclosure will be described with reference to FIG. 25 and FIG. 26.

In the toner container 181 (an example of a toner case) according to the fourth embodiment, the components other than the moving mechanism 182 and the shutter 183 have the approximate same configurations as the toner container 15 according to the first embodiment, and their detail explanations are omitted.

The moving mechanism 182 of the toner container 181 includes the holder 186 and the coil spring 187 (an example of a pressing member).

The holder 186 of the moving mechanism 182 is movable along the left-and-right direction (the rotation axis directions of the agitator 22 and the conveyer 23) with respect to the case main body 21 between the first holding position (refer to FIG. 25) where the holder 186 holds the transmitter 25 in the first position and the second holding position (refer to FIG. 26) where the holder 186 holds the transmitter 25 in the second position.

The holder 186 includes a base part 189 formed in a cylindrical shape with the first rotation axis X as an axis center, an arm part 190 extending linearly from an outer circumferential face of the base part 189 to an outside in a radial direction (a direction separated from the first rotation axis X), and a first rack piece 191 extending linearly from an end portion at the outside in the radial direction of the arm part 190 to the left side (the inside in the left-and-right direction). The base part 189 rotatably holds the transmitter 25. On a lower face of the first rack piece 191, a first rack gear 192 is provided. The first rack gear 192 is meshed with a pinion gear 193 from an upper side.

The coil spring 187 of the moving mechanism 182 is interposed between the supporter 24 and the transmitter 25. The coil spring 187 presses the transmitter 25 to the right side (the outside in the left-and-right direction), and the transmitter 25 is pressed against the holder 186 by the coil spring 187.

The shutter 183 of the toner container 181 includes a shutter main body 194 and a second rack piece 195 extending from a right end portion of the shutter main body 194 to the right side (the outside in the left-and-right direction). The shutter main body 194 is arranged along a lower face (an outer face) of the storage 31 of the case main body 21. On an upper face of the second rack piece 195, a second rack gear 196 is provided. The second rack gear 196 is meshed with the pinion gear 193 from a lower side.

Figure 25:
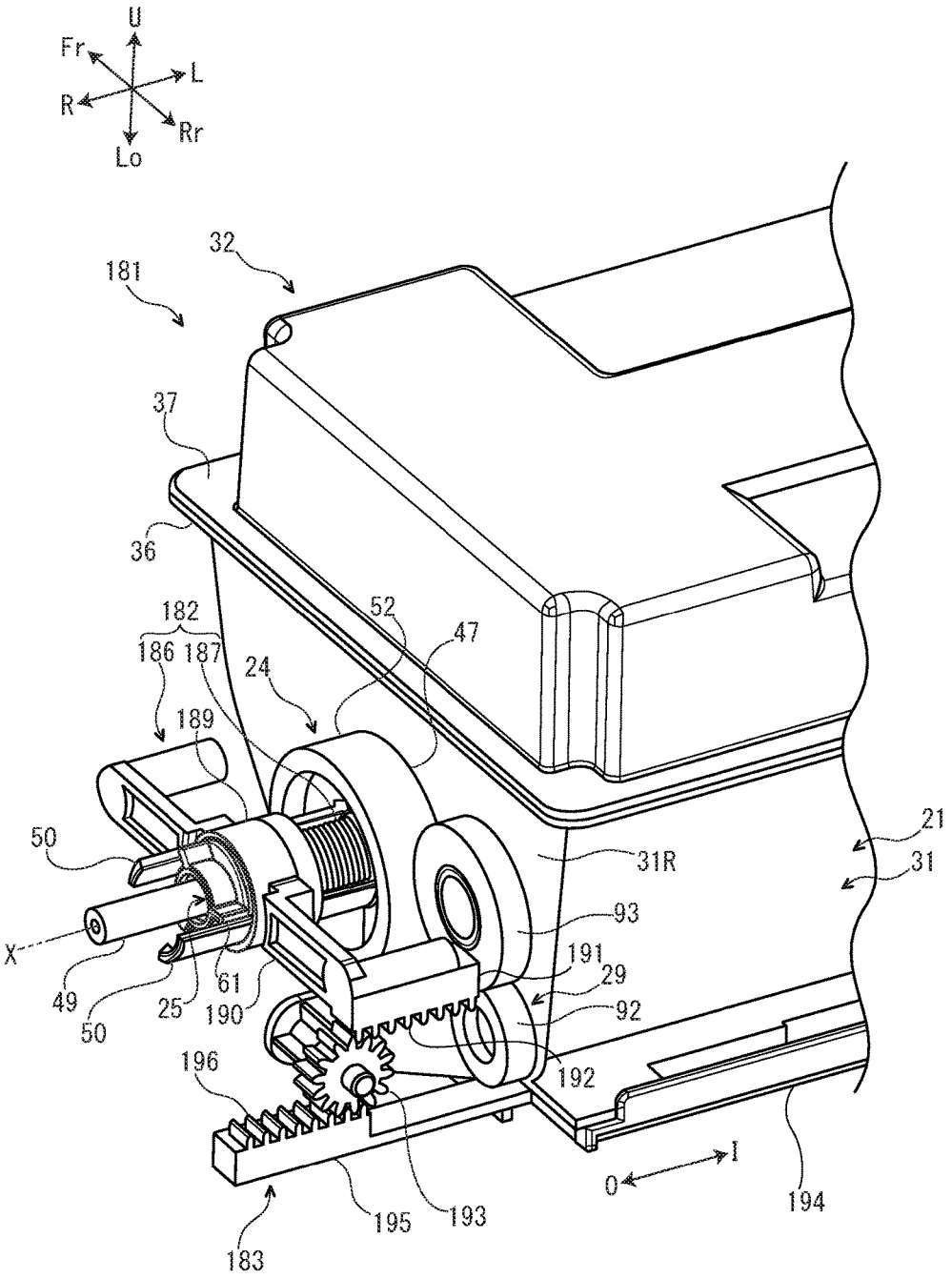
FIG. 25 is a perspective view showing a state where the holder is in the first holding position, in the toner container according to a fourth embodiment of the present disclosure.
Figure 26:
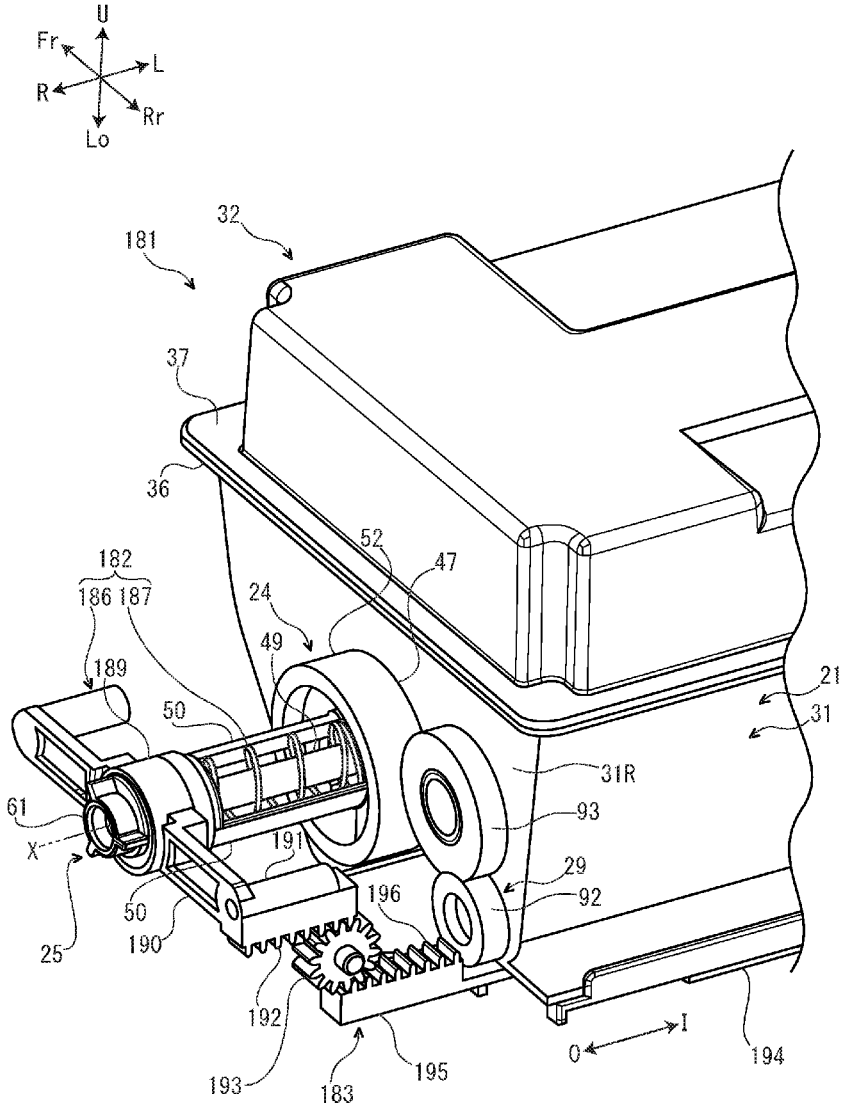
FIG. 26 is a perspective view showing a state where the holder is in the second holding position, in the toner container according to the fourth embodiment of the present disclosure.

In the toner container 181 having the above described configuration, in a state where the holder 186 is arranged in the first holding position (refer to FIG. 25), the transmitter 25 is held in the first position by the holder 186, and the transmitting coupling 61 of the transmitter 25 is retracted to the inside of the through hole 79 of the cover 27 (not shown in FIG. 25 and FIG. 26). The shutter main body 194 of the shutter 183 closes the discharge port 33 of the case main body 21.

From this state, when the shutter 183 is moved to the left side (one side in the left-and-right direction), the shutter main body 194 of the shutter 183 opens the discharge port 33 of the case main body 21. Consequently, the holder 186 connected to the shutter 183 via the pinion gear 193 moves to the right side (the other side in the left-and-right direction) with respect to the case main body 21 from the first holding position (refer to FIG. 25) to the second holding position (refer to FIG. 26). Consequently, the transmitter 25 held by the holder 186 moves from the first position to the second position, and the transmitting coupling 61 of the transmitter 25 protrudes to the right side (the outside in the left-and-right direction) further than the through hole 79 of the cover 27. Thereby, the transmitting coupling 61 is enabled to be coupled to the driving coupling 104.

From this state, when the shutter 183 is moved to the right side (the other side in the left-and-right direction), the shutter main body 194 of the shutter 183 closes the discharge port 33 of the case main body 21. Consequently, the holder 186 connected to the shutter 183 via the pinion gear 193 moves to the left side (the one side in the left-and-right direction) with respect to the case main body 21 from the second holding position (refer to FIG. 26) to the first holding position (refer to FIG. 25). Consequently, the transmitter 25 held by the holder 186 moves from the second position to the first position, and the transmitting coupling 61 of the transmitter 25 is retracted to the inside of the through hole 79 of the cover 27. Thereby, the coupling of the transmitting coupling 61 to the driving coupling 104 is released.

In the present embodiment, the holder 186 of the moving mechanism 182 moves along the left-and-right direction from the first holding position (refer to FIG. 25) where the holder 186 holds the transmitter 25 in the first position and the second holding position (refer to FIG. 26) where the holder 186 holds the transmitter 25 in the second position. By applying such a configuration, it becomes possible to move the transmitter 25 along the left-and-right direction by a simple structure.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body storing a toner;

a rotator stored in the case main body and rotating around a rotation axis;

a transmitter arranged outside the case main body and transmitting rotation to the rotator; and a moving mechanism which moves the transmitter between a first position and a second position which is arranged at an outside of the first position in a rotation axis direction of the rotator, wherein the moving mechanism includes a holder holding the transmitter, as the holder moves with respect to the case main body, the transmitter moves between the first position and the second position.

2. The toner case according to claim 1, wherein the holder rotates between a first holding position where the holder holds the transmitter in the first position and a second holding position where the holder holds the transmitter in the second position.

3. The toner case according to claim 2, wherein the moving mechanism further includes:

a biasing member biasing the holder to the second holding position; and a locking mechanism holding the holder in the first holding position against biasing force of the biasing member.

4. The toner case according to claim 3, further comprising a cover covering an outside of the case main body in the rotation axis direction, wherein the locking mechanism includes:

a first projection provided on one of the holder and the cover; and a second projection provided on another of the holder and the cover, and engaging with the first projection.

5. The toner case according to claim 3, further comprising a supporter connected to the rotator, wherein the transmitter is supported by the supporter in a state where the transmitter is movable in the rotation axis direction and is not rotatable with respect to the supporter, and the biasing member is interposed between the supporter and the transmitter.

6. The toner case according to claim 2, further comprising a manipulation member arranged outside the case main body and movable between a first manipulating position and a second manipulating position, wherein as the manipulation member moves between the first manipulating position and the second manipulating position, the holder rotates between the first holding position and the second holding position.

7. The toner case according to claim 2, further comprising a cover covering an outside of the case main body in the rotation axis direction, wherein the cover includes:

a main wall having a through hole; and a guide wall protruding from the main wall at an outer circumference of the through hole toward an inside in the rotation axis direction, wherein a part of the holder is inserted in the guide wall.

8. The toner case according to claim 7, wherein a guide part is formed on an edge of the guide wall at an inside in the rotation axis direction, at least a part of the guide part is inclined to an outside in the rotation axis direction from an upstream side to a downstream side in a rotating direction of the holder from the first holding position to the second holding position, and the holder includes a guided part which comes into contact with the part of the guide part.

9. The toner case according to claim 1, wherein the holder moves along the rotation axis direction between a first holding position where the holder holds the transmitter in the first position and a second holding position where the holder holds the transmitter in the second position.

10. The toner case according to claim 1, further comprising a cover covering an outside of the case main body in the rotation axis direction, wherein an entire portion of the transmitter is retracted inside the cover in a state where the transmitter is held in the first position, and a part of the transmitter is protruded to an outside of the cover in the rotation axis direction in a state where the transmitter is held in the second position.

11. The toner case according to claim 1, wherein the transmitter moves linearly along the rotation axis direction between the first position and the second position.

12. An image forming apparatus comprising:

the toner case according to claim 1; and an attachment part to which the toner case is detachably attached.

13. A toner case detachably attached to an attachment part of an image forming apparatus, the toner case comprising:

a case main body storing a toner;

a rotator stored in the case main body and rotating around a rotation axis;

a transmitter arranged outside the case main body and transmitting rotation to the rotator; and a moving mechanism which moves the transmitter between a first position and a second position which is arranged at an outside of the first position in a rotation axis direction of the rotator, wherein the moving mechanism includes a holder holding the transmitter, the attachment part includes a restriction part which comes into contact with the holder to restrict rotation of the holder, and as the case main body rotates with respect to the holder in a state where the restriction part comes into contact with the holder, the transmitter moves from the first position to the second position.

14. An image forming apparatus comprising:

a toner case; and an attachment part to which the toner case is detachably attached, wherein the toner case includes:

a case main body storing a toner;

a rotator stored in the case main body and rotating around a rotation axis;

a transmitter arranged outside the case main body and transmitting rotation to the rotator; and a moving mechanism which moves the transmitter between a first position and a second position which is arranged at an outside of the first position in a rotation axis direction of the rotator, wherein the moving mechanism includes a holder holding the transmitter, the attachment part includes a restriction part which comes into contact with the holder to restrict rotation of the holder, and as the case main body rotates with respect to the holder in a state where the restriction part comes into contact with the holder, the transmitter moves from the first position to the second position.

15. The image forming apparatus according to claim 14, wherein the transmitter includes a transmitting coupling, the attachment part includes a driving coupling which rotates by rotation driving force of a driving source, and as the case main body rotates with respect to the holder in the state where the restriction part comes into contact with the holder, the transmitter moves from the first position to the second position and the transmitting coupling is coupled to the driving coupling.

16. The image forming apparatus according to claim 14, wherein the holder moves between a first holding position where the holder holds the transmitter in the first position and a second holding position where the holder holds the transmitter in the second position, the moving mechanism further includes a biasing member which biases the holder to the second holding position, as the toner case is attached to the attachment part, the restriction part comes into contact with the holder and the holder moves from the second holding position to the first holding position against biasing force of the biasing member, and as the case main body rotates with respect to the holder in a state where the toner case is attached to the attachment part, the holder moves from the first holding position to the second holding position by the biasing force of the biasing member.

17. The image forming apparatus according to claim 14, wherein the holder moves between a first holding position where the holder holds the transmitter in the first position and a second holding position where the holder holds the transmitter in the second position, the moving mechanism further includes:

a biasing member biasing the holder to the second holding position; and a locking mechanism holding the holder to the first holding position against biasing force of the biasing member, and as the case main body rotates with respect to the holder in a state where the toner case is attached to the attachment part, a pressing face provided on the attachment part presses the holder, holding of the holder in the first holding position by the locking mechanism is released, and the holder moves from the first holding position to the second holding position by the biasing force of the biasing member.

* * * * *